US011148879B2

(12) United States Patent
Rugg et al.

(10) Patent No.: US 11,148,879 B2
(45) Date of Patent: Oct. 19, 2021

(54) WASTE BASKET LINER SECURING APPARATUS

(71) Applicants: Richard H. Rugg, Greenland, NH (US); Mark D. Lorusso, Portsmouth, NH (US)

(72) Inventors: Richard H. Rugg, Greenland, NH (US); Mark D. Lorusso, Portsmouth, NH (US)

( * ) Notice: Subject to any disclaimer, the term of this patent is extended or adjusted under 35 U.S.C. 154(b) by 158 days.

(21) Appl. No.: 16/411,078

(22) Filed: May 13, 2019

(65) Prior Publication Data

US 2019/0263588 A1 Aug. 29, 2019

Related U.S. Application Data

(63) Continuation-in-part of application No. 15/460,143, filed on Mar. 15, 2017, now Pat. No. 10,287,093.

(51) Int. Cl.
*B65F 1/06* (2006.01)
*B65F 1/14* (2006.01)

(52) U.S. Cl.
CPC ..... *B65F 1/06* (2013.01); *B65F 1/065* (2013.01); *B65F 1/1415* (2013.01); *B65F 2001/061* (2013.01); *B65F 2220/12* (2013.01); *B65F 2250/114* (2013.01)

(58) Field of Classification Search
CPC ..... B65F 1/06; B65F 1/065; B65F 2001/061; B65F 1/141; B65F 1/1415
USPC ..... 220/495.1, 495.08
See application file for complete search history.

(56) References Cited

U.S. PATENT DOCUMENTS 8,827,103 B1 * 9/2014 Engstrom ..... B65F 1/062 220/495.08
2002/0130224 A1 * 9/2002 Asaro ..... B65F 1/06 248/95

* cited by examiner

*Primary Examiner* — Mollie Impink
(74) *Attorney, Agent, or Firm* — Lorusso & Associates

(57) ABSTRACT

A waste-basket-liner-bag-retaining apparatus including a pair of liner bag retaining apertures formed on opposing sides of a waste basket to receive and secure a waste basket liner bag. Reusable aperture covers can be secured over the apertures to occlude the apertures. A waste-basket-liner-bag-retaining apparatus includes hook inserts secured to either side of a waste basket to provide hooks for retaining an end of a waste basket liner bag. In another embodiment, two sets of magnets, each set formed within, or secured to inner surfaces of, opposing waste basket container walls of a waste basket container that secured magnetized hooks. A waste-basket-liner-bag-retaining apparatus includes apertures formed on opposing sides of a waste basket container, each with a retractable cover to secure portions of a liner bag in the apertures. The retractable covers may include rotatable bag retaining tabs.

7 Claims, 20 Drawing Sheets

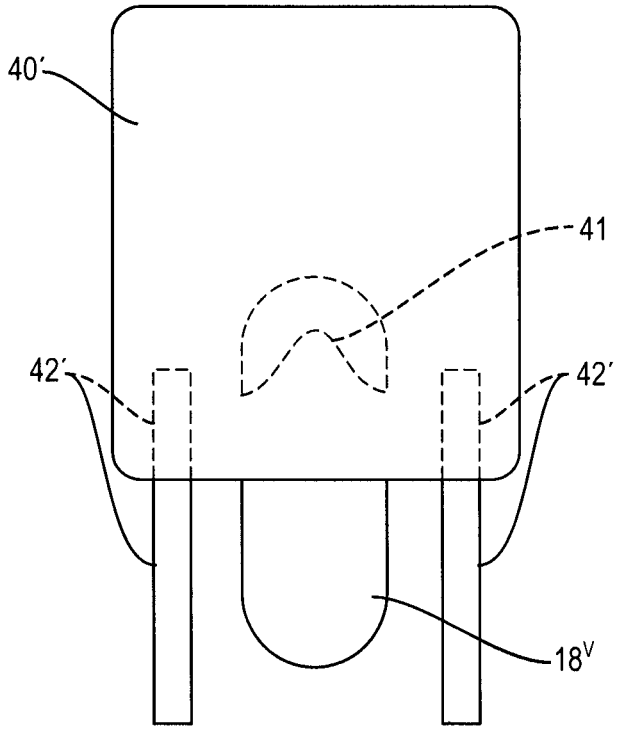
FIG. 21
FIG. 22
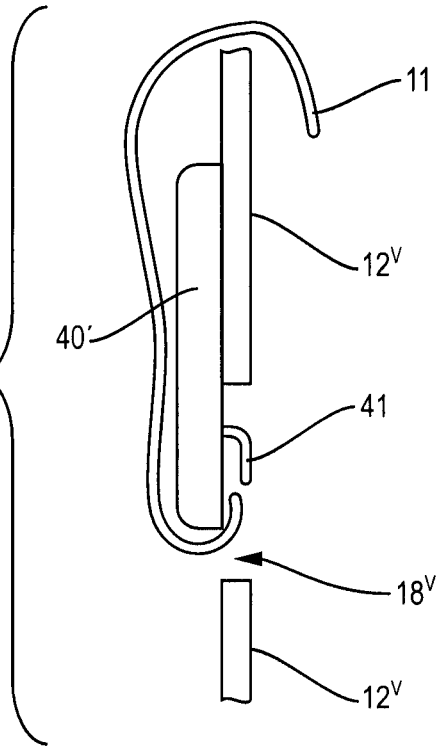

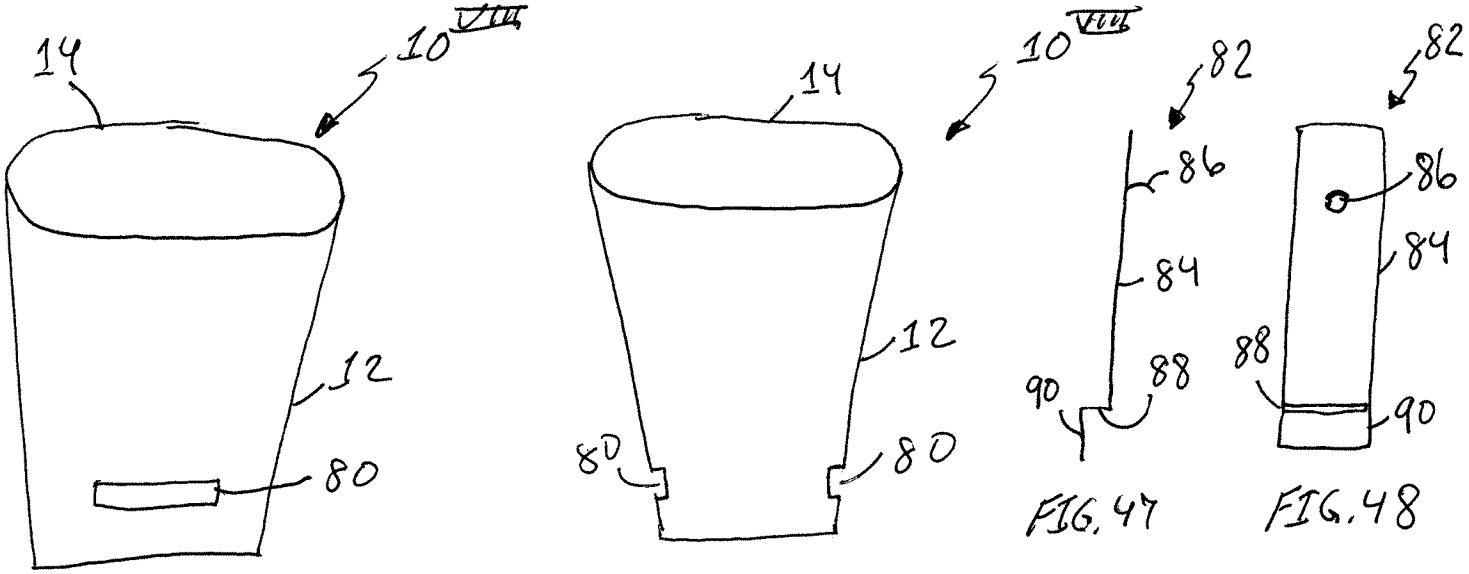
FIG. 45
FIG. 46
FIG. 47
FIG. 48
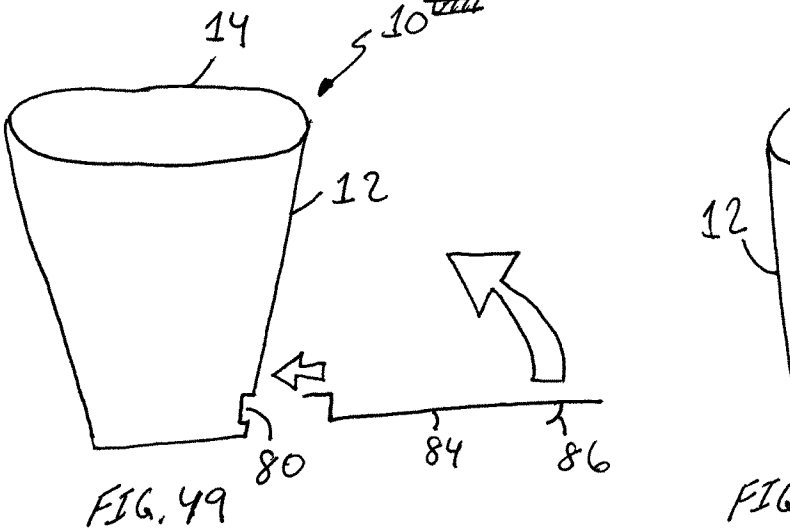
FIG. 49
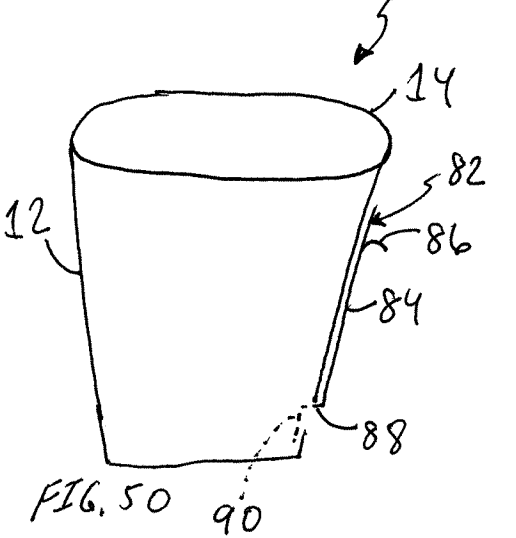
FIG. 50

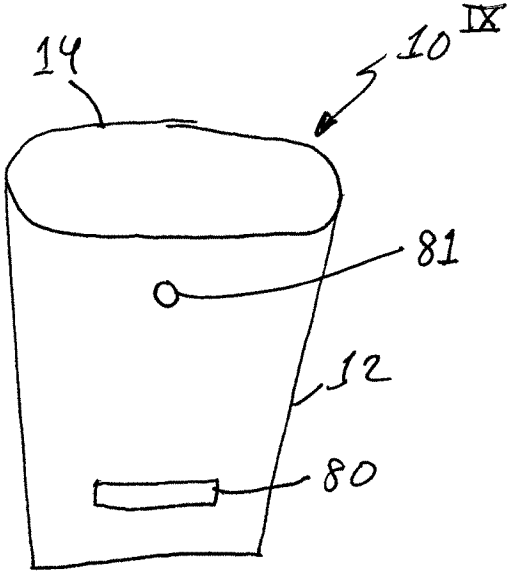
FIG. 51
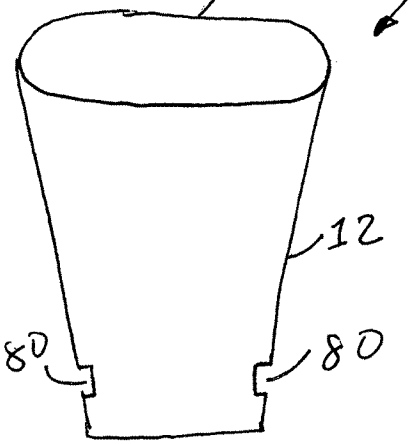
FIG. 52
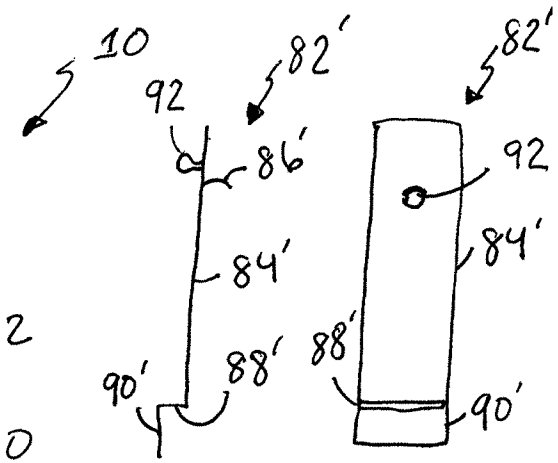
FIG. 53
FIG. 54
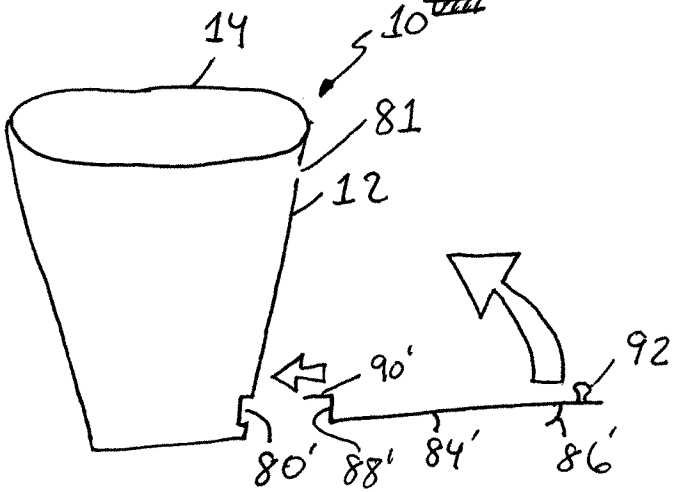
FIG. 55
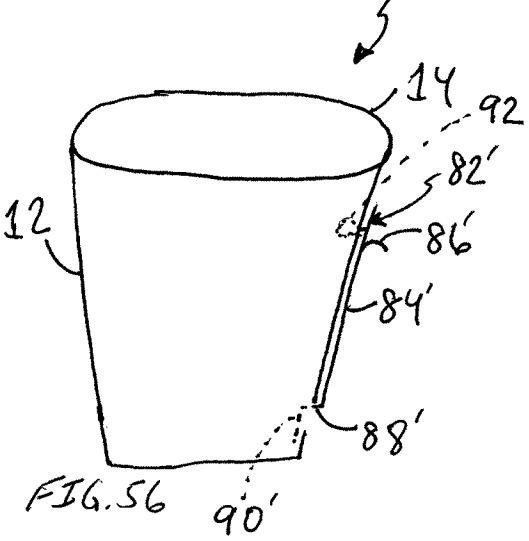
FIG. 56

WASTE BASKET LINER SECURING APPARATUS

CROSS-REFERENCE TO RELATED APPLICATIONS

This is a Continuation-In-Part Application of U.S. Regular Utility application Ser. No. 15/460,143, filed Mar. 15, 2017, now U.S. Pat. No. 10,287,093, issued May 14, 2019, the contents of which are incorporated herein by reference.

FIELD OF THE DISCLOSURE

The disclosure relates to containers modified to secure plastic bag liners to the containers. More particularly, the disclosure relates to waste basket modifications that permit the complete lining of a waste basket container with a plastic bag regardless of plastic bag size.

BACKGROUND OF THE DISCLOSURE

As is a common practice, waste baskets, garbage cans, waste containers, vessels and the like are lined with repurposed grocery or department store shopping bags that provide a convenient, low cost means to collect and discard refuse without having to clean the container. Once the plastic bag is filled, the bag can be removed from the container and disposed of in a number of ways such as municipal curbside refuse pickup. To secure plastic bags to waste containers, multiple methods have been developed to temporarily secure the plastic bags to the containers. One method is to use large elastic bands to secure a top edge of a plastic bag under a waste basket lip. The approach is fraught with problems such as breaking rubber bands and slippage if the bag does not reach the bottom of the waste basket and the garbage placed in the bag is heavy, the bag can slip out of the rubber band until the weight is supported by the bottom of the waste basket.

Other approaches to secure plastic bags to waste containers include the application of hook-like appendages to the outside wall of the containers, clips and modified rims to create bag registration slots. Use of appendages prevents nesting waste containers as the appendages prevent one waste basket from nesting inside another similarly structured waste basket. Use of slots in the container rim prevents complete coverage of the rim with the liner. What is needed is a plastic bag liner retaining structure that provides an easy method to secure a bag to a container and maintain coverage of the rim regardless of liner bag size. What is also needed is a liner bag retaining structure that also permits waste containers to be nested for storage or for sale.

SUMMARY OF THE DISCLOSURE

In one aspect of the disclosure, liner retaining apertures are formed in opposing sides of a multi-sided waste disposal vessel. The apertures have converging sloped slots that connect to an ovoid-like slot formed to permit the insertion of a plastic bag edge into the slot with two or more fingers. The converging slots form an apex that functions as a hook to secure a bag edge within the slots. The remainder of the bag extends over the entire rim of the disposal vessel and extends down into the vessel to occupy a portion of the vessel volume.

In another aspect of the disclosure, a series of perforations collectively arranged to outline liner retaining apertures are formed on opposing sides of a waste disposal vessel to form liner retaining aperture cutouts. The cutouts enable a user to remove the cutouts with the application of force. The removal of the cutouts results in the formation of liner retaining apertures.

In another aspect of the disclosure, a pair of lines formed on opposing sides of a waste disposal vessel outline liner retaining segments. The lines are reduced thickness segments of the vessel wall that permit the liner retaining segments to be removed from the disposal vessel with the application of force on the segments. The reduced thickness segments break away and leave liner retaining apertures. The edges of the apertures provide registration surfaces for the top edges of plastic bags to secure the bags to the disposal vessel.

In a further aspect of the disclosure, a waste disposal vessel if formed with a pair of bag liner retaining apertures with snap-fit covers. The covers conform to the general shape of the apertures. Each aperture cover includes a plurality of deformable locking tabs to releasably secure the covers to the apertures.

In yet a further aspect of the disclosure, a waste disposal vessel includes a series of spaced magnet sets positioned either in the wall of the vessel or attached to an inner side of the vessel wall. The magnet sets are positioned on opposing sides of the disposal vessel. A liner bag retaining magnetized hook is positioned over one of the magnets to secure a bag liner to the vessel. The position of the magnetized hook can be changed by magnetically securing it to a differently positioned magnet in a magnet set to accommodate differently sized bags.

In another aspect of the disclosure, a waste disposal vessel is formed with bag liner retaining apertures and retractable aperture covers. The spring actuated aperture cover covers the bag liner retaining aperture when in an un-retracted position. To secure a bag liner to the vessel, the cover is retracted to expose the aperture. After positioning the bag edge inside the aperture, the cover is released to return to the closed, un-retracted position to releasably secure the liner bag to the waste disposal vessel.

In another aspect of the disclosure, a waste disposal vessel is formed with liner bag apertures positioned on opposing sides of the vessel. A hook is formed on, or secured to, an inner wall of the vessel and positioned directly above the aperture. The hook provides positive engagement of a bag top edge inserted into the aperture to secure a bag as a liner in the disposal vessel.

In a further aspect of the disclosure, a waste disposal vessel is formed with bag liner retaining apertures on opposing sides of the vessel. Each aperture has a dedicated retractable cover. Each retractable cover is formed with a hook on an inner wall surface that provides positive engagement of a top edge of a bag used to line the vessel.

In yet another aspect of the disclosure, a waste disposal vessel is formed with liner bag retaining apertures on opposing sides of the vessel. Each aperture has a dedicated retractable cover. Each cover is formed with a rotatable torsion-spring controlled bag securing tab hinged to an inner wall of the cover. Retraction of the cover above the aperture causes the tab to register against a top end of the aperture to rotate the tab into a substantially parallel orientation with the cover. After a bag edge is inserted into the aperture and over the tab, the cover is returned to an un-retracted position that permits the tab to rotate back to its folded start position that positively secures the bag edge inside the bag retaining aperture.

In a still further aspect of the disclosure, a waste disposal vessel is formed with liner bag retaining apertures on opposing sides of the vessel. Each aperture has a dedicated retractable cover. Each cover is formed with a bag securing tab hinged to an inner wall of the cover. Retraction of the cover below the aperture causes the tab to register against a bottom end of the aperture to rotate the tab into a substantially parallel orientation with the cover. After a bag edge is inserted into the aperture and over the tab, the cover is returned to an un-retracted position that permits the tab to rotate back to its folded start position that positively secures the bag edge inside the bag retaining aperture.

In yet a further aspect of the disclosure, a waste disposal vessel is formed with a pair of diametrically-opposed slots proximal to a bottom of the vessel. A pair of hook inserts are each secured within one of the slots at a distal end and secured to the side of the vessel at a proximal end. When assembled, the hook inserts align hooks on opposite sides of the vessel to permit the releasable attachment of a waste disposal vessel liner. These and other aspects of the disclosure will become apparent from a review of the appended drawings and a reading of the following detailed description of the disclosure.

BRIEF DESCRIPTION OF THE DRAWINGS

FIG. 21 is a front view in elevation and partial phantom of the retractable aperture cover shown in FIG. 19 in a retracted position.

FIG. 22 is a side partial sectional view of the waste disposal vessel with retractable cover shown in FIG. 19 with a bag liner partially engaged to the partially retracted cover.

FIG. 45 is a front view in elevation of a waste disposal vessel with a slot according to another embodiment of the disclosure.

FIG. 46 is a side view in elevation of the waste disposal vessel shown in FIG. 45.

FIG. 47 is a side view in elevation of a hook insert according to the embodiment of the disclosure shown in FIG. 45.

FIG. 48 is a front view in elevation of the hook insert shown in FIG. 47.

FIG. 49 is an exploded view of a waste disposal vessel and a hook insert according to the embodiment of the disclosure shown in FIG. 45.

FIG. 50 is a side view in elevation of a waste disposal vessel with a hook insert assembled to the vessel according to the embodiment of the disclosure shown in FIG. 45.

FIG. 51 is a front view in elevation of a waste disposal vessel with a slot and a hook insert receiving bore according a still further embodiment of the disclosure.

FIG. 52 is a side view in elevation of the waste disposal vessel shown in FIG. 51.

FIG. 53 is a side view in elevation of a hook insert with a securing knob according to the embodiment of the disclosure shown in FIG. 51.

FIG. 54 is a back view in elevation of the hook insert shown in FIG. 53.

FIG. 55 is an exploded view of a waste disposal vessel and a hook insert according to the embodiment of the disclosure shown in FIG. 51.

FIG. 56 is a side view in elevation of a waste disposal vessel with a hook insert assembled to the vessel according to the embodiment of the disclosure shown in FIG. 51.

DETAILED DESCRIPTION OF THE DISCLOSURE

Figure 1:
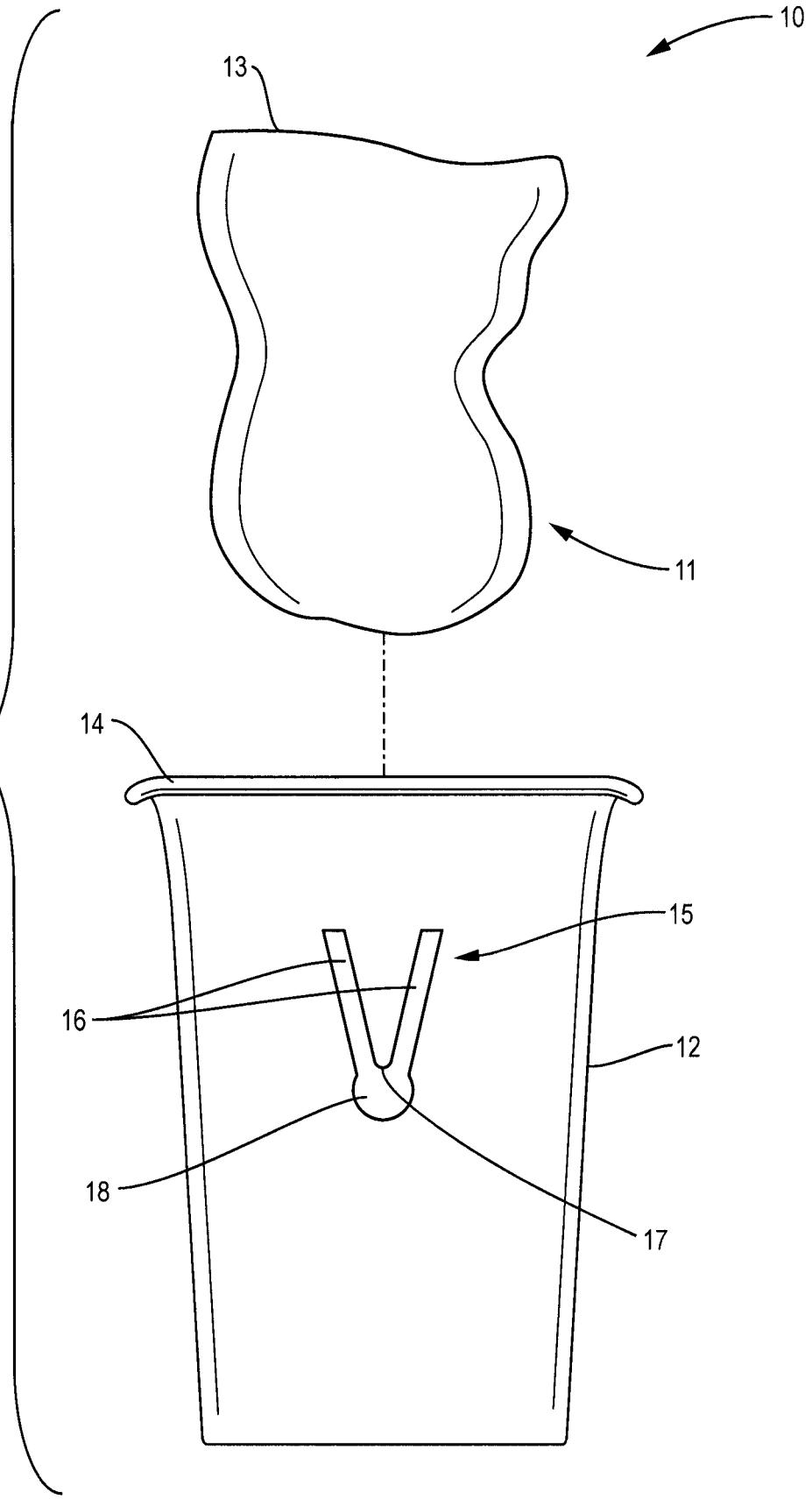
FIG. 1 is a front view in elevation of a waste disposal vessel with preformed liner retaining apertures according to one embodiment of the disclosure.

Referring to FIG. 1, in one aspect of the disclosure, a waste basket container, shown generally as 10, includes a waste basket wall 12 with a flanged waste basket rim 14 formed on a top end of the wall. The wall may be a continuous circular or ovoid shape in cross-section, may be multi-sided such as square or rectangular, or may conform to any regular or irregular geometric shape in cross-section. Regardless of the wall shape, the continuous rim provides a radiused profile that prevents snagging or finger capture points when placing refuse in the container. The radiused rim also provides a smooth edge against which to insert a plastic shopping bag repurposed as a liner in the waste basket. As used herein, waste basket and waste basket container shall mean any can, waste can, trash bin, container or vessel that defines a volume used to collect refuse. The waste basket can have an optional top.

To permit a plastic bag to be secured to waste basket 10, bag retention apertures 15 are formed in opposing sides of basket 10. Each aperture 15 includes two converging slots 16 that terminate in an enlarged circular or ovoid aperture 18. Ovoid aperture 18 is dimensioned to permit an individual to insert one or more fingers and even part of a hand in the ovoid aperture 18 to secure a liner bag 11 as explained in more detail below. The junction of the slots 16 form a radiused apex 17 that functions as a bag retaining surface when a bag is secured in the aperture. In an alternative embodiment, aperture 15 may be formed as a semi-circular or parabolic shape with the apex of the partial circle or parabola facing downwardly away from rim 14. Such shapes eliminate any jagged edges that could perforate or tear an attached liner bag. This use of apertures to secure plastic shopping bags is particularly advantageous to allow nesting of a plurality of same-sized waste baskets as the liner bag retaining structures to not add to the surface profile of the waste basket container.

Figure 12:
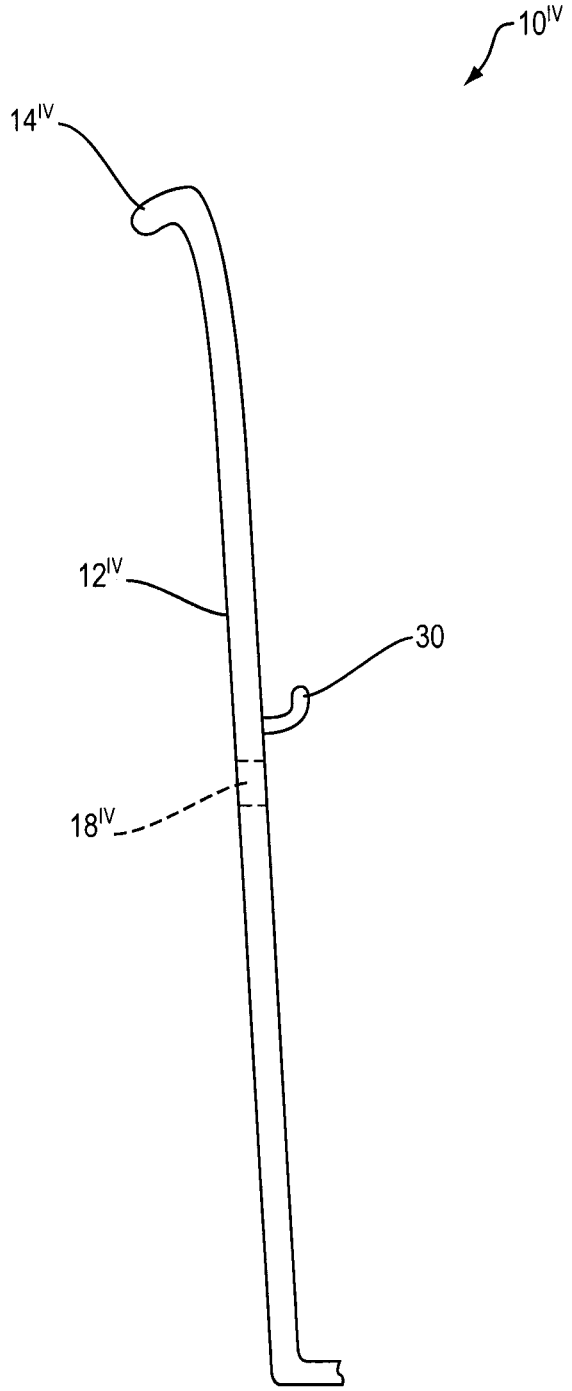
FIG. 12 is a side sectional view in partial phantom of a waste disposal vessel with an internal hook according to a still further embodiment of the disclosure.

To secure liner bag 11 to waste basket 10, a user grasps a portion of a bag top edge 13 (or bag handles, if present), and inserts the grabbed portion through aperture 18. The bottom end of the bag is urged into basket 10 to cause top edge 13 to register against apex 17 with a portion of the bag migrating into and residing in slots 16. Any items put in liner bag 11 will travel to the bottom of the bag and create a force on the bag that causes the bag portion in aperture 15 to be secured in, and releasably locked into, retention aperture 15. For differently sized plastic bags, the amount of the top edge inserted into the bag retention aperture can be modified to accommodate specific bag sizes. For larger bags, a relatively large portion of the bag top edge can be inserted into the retention aperture to fit the bag to the container. For smaller plastic bags, a relatively smaller portion of the bag top edge can be inserted into the retention aperture to ensure complete coverage of the container rim. By adjusting the amount of liner bag 11 inserted into retention aperture 15, a user can ensure the liner bag maintains complete coverage of the entire rim 14 when refuse is loaded into the liner bag. By adjusting the amount of bag inserted into retention aperture 15, a user can set the tension applied to liner bag 11 to ensure the bag does not partially slip off rim 14 when loaded with refuse To more positively engage a liner bag edge or handles, in a further aspect of the disclosure as shown in FIG. 12, a waste basket container shown generally as $\mathbf{10}^{IV}$ is formed with a wall $\mathbf{12}^{IV}$, a rim $\mathbf{14}^{IV}$, a bag retention aperture $\mathbf{18}^{IV}$, and an upwardly facing internal hook 30 formed or secured to an inner surface of wall $\mathbf{12}^{IV}$ above aperture $\mathbf{18}^{IV}$. As used herein, identical reference characters having differently primed or unprimed variations and assigned to features are intended to identify different embodiments of the same feature. In a similar method to that used to secure a plastic bag liner to waste basket 10, a bottom end of a bag liner is inserted into the open volume of basket $\mathbf{10}^{IV}$ and a bag handle or bag edge is grasped and inserted into each of the present apertures $\mathbf{18}^{IV}$. The bag handle or grasped and bunched edge is then urged over internal hook 30 with one or more fingers inserted into aperture $\mathbf{18}^{IV}$.

To remove bag liner 11 from the embodiment shown in FIG. 1, an individual inserts one or more fingers into ovoid aperture 18, grasps the portion of the bag lodged against apex 17 and rolls the edge over the apex and out of aperture 15. The liner bag can now be lifted out of waste basket 10. For the embodiment shown in FIG. 12, a user will insert one or more fingers into aperture $\mathbf{18}^{IV}$ and lift either the bag handle or the bunched bag edge off the hook and pull the handle or edge out of aperture $\mathbf{18}^{IV}$. The filled liner bag can then be lifted out of and removed from the waste basket.

Figure 2:
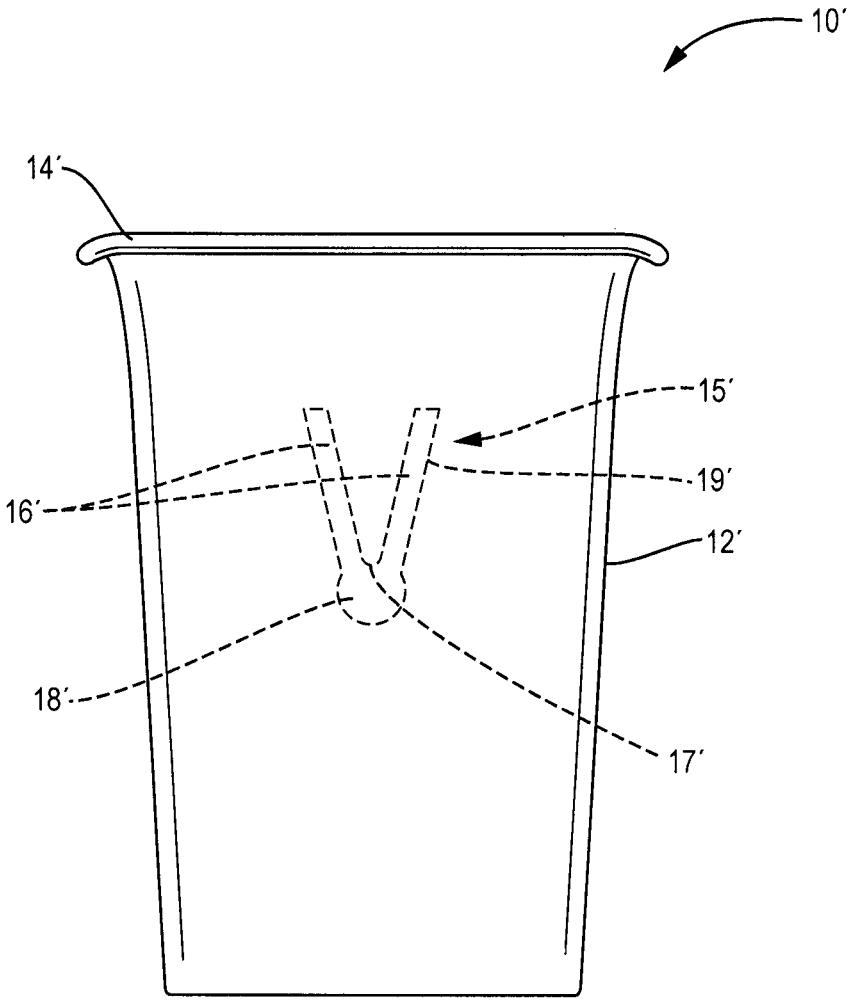
FIG. 2 is a front view in elevation of a waste disposal vessel with a resident frangible liner retaining cutout according to another embodiment of the disclosure.

In another aspect of the disclosure, as shown in FIG. 2, a waste basket shown generally as 10' is formed with bag retention aperture patterns 15' formed on opposing sides or ends of waste basket 10'. The aperture patterns are defined by frangible lines 19 that outline and define two converging slots 16' and one circular or ovoid shaped aperture 18'. The frangible lines 19 are areas of the waste basket material that have been structurally weakened by creating a plurality of partial or through bores along the lines. The partial or through bores reduce the amount of material that forms frangible lines 19. In addition to the bores, frangible lines 19 may also be created or formed to have smaller cross-sectional thicknesses than the cross-sectional thickness of the surrounding waste basket wall 12'. Frangible lines 19 function as fracture lines that will fail with the application of pressure. This permits the portions of the waste basket within the frangible lines to be forcibly removed to create bag retaining apertures such as those shown and described for waste basket 10.

Forming waste basket 10' with frangible punch-out sections permits an owner to maintain the waste basket as a conventional waste basket. It also provides the flexibility to convert the waste basket by removing the punch-outs so bag retaining apertures are present to receive and secure plastic bag liners. This embodiment is also advantageous to permit nesting of multiple waste baskets as the punch-outs do not alter the surface profile of the waste basket containers.

Figure 3:
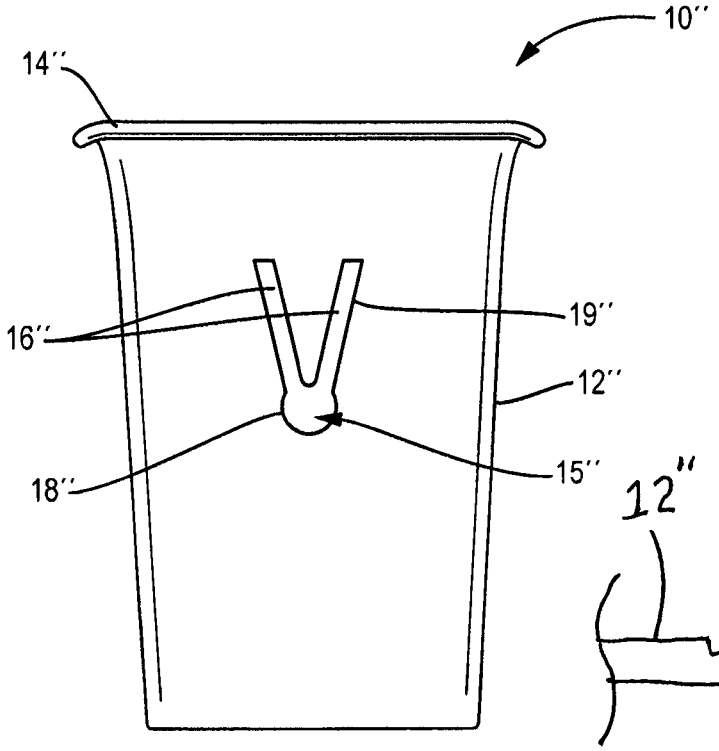
FIG. 3 is a front view in elevation of a waste disposal vessel with a resident frangible liner retaining cutout with a thickness reduced weakened margin according to a further embodiment of the disclosure.
Figure 44:
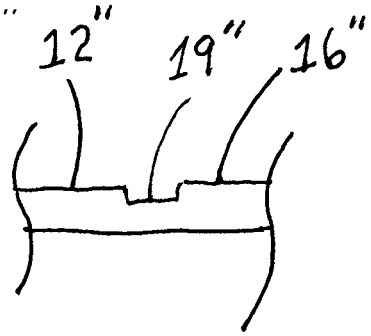
FIG. 44 is a cross-sectional view of the waste basket wall and an aperture cutout with a reduced-thickness frangible section connecting the waste basket wall and aperture cutout according to a further embodiment of the disclosure.
Figure 4:
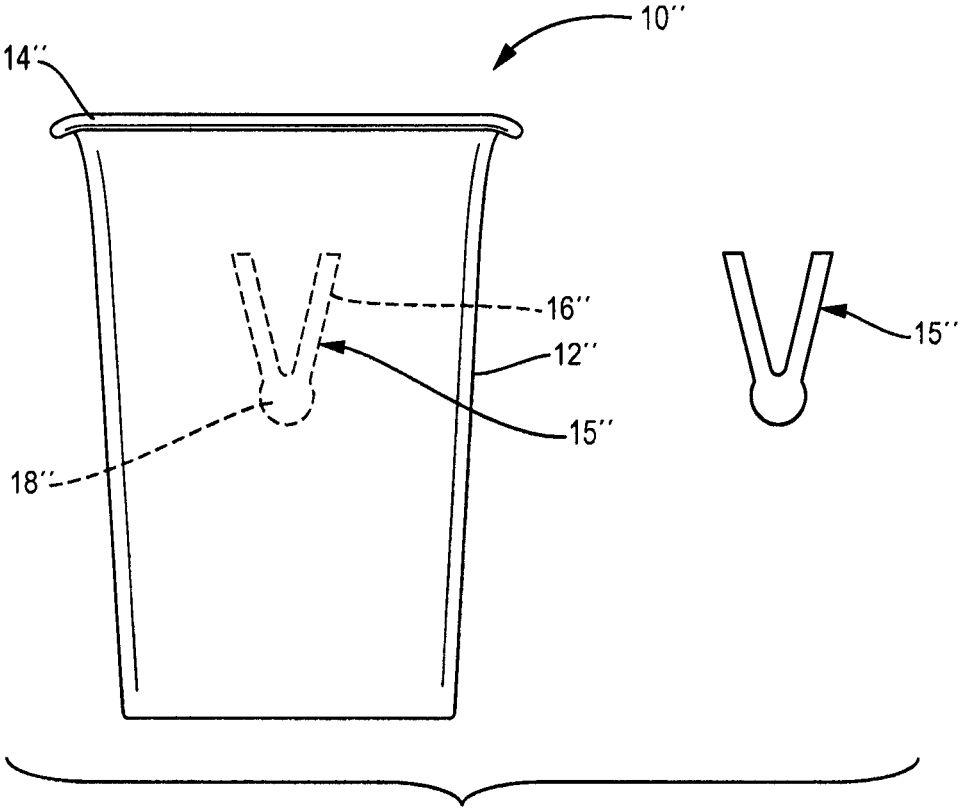
FIG. 4 is an exploded view of the waste disposal vessel shown in FIG. 3 with the liner retaining cutout removed from the waste disposal vessel.

Referring now to FIGS. 3 and 4, in a further aspect of the disclosure, a waste basket shown generally as 10" is formed with bag retaining aperture patterns 15" formed on opposing sides of waste basket 10". The aperture patterns are defined by frangible lines 19" that outline define two converging slots 16" and one circular or ovoid shaped aperture 18". In this embodiment, the frangible lines 19 are areas of the waste basket material that have been structurally weakened by reducing the cross-sectional thickness of the lines relative to the thickness of the surrounding waste basket wall 12". Like waste basket 10', this permits the portions of the waste basket within the frangible lines to be forcibly removed to create bag retaining apertures such as those shown and described for waste basket 10. Pressure applied to the cut-out near the frangible lines 19" cause the lines to fracture and release the cutout. A bag liner retaining aperture results from the removal of the cutout. Again, like waste basket 10', by forming waste basket 10' with the frangible punch-out sections permits an owner to maintain the waste basket as a conventional waste basket, or to convert the waste basket by removing the punch-outs so bag retaining apertures are present to receive and secure plastic bag liners. This embodiment is also suitable for nesting same-sized waste baskets.

Figure 5:
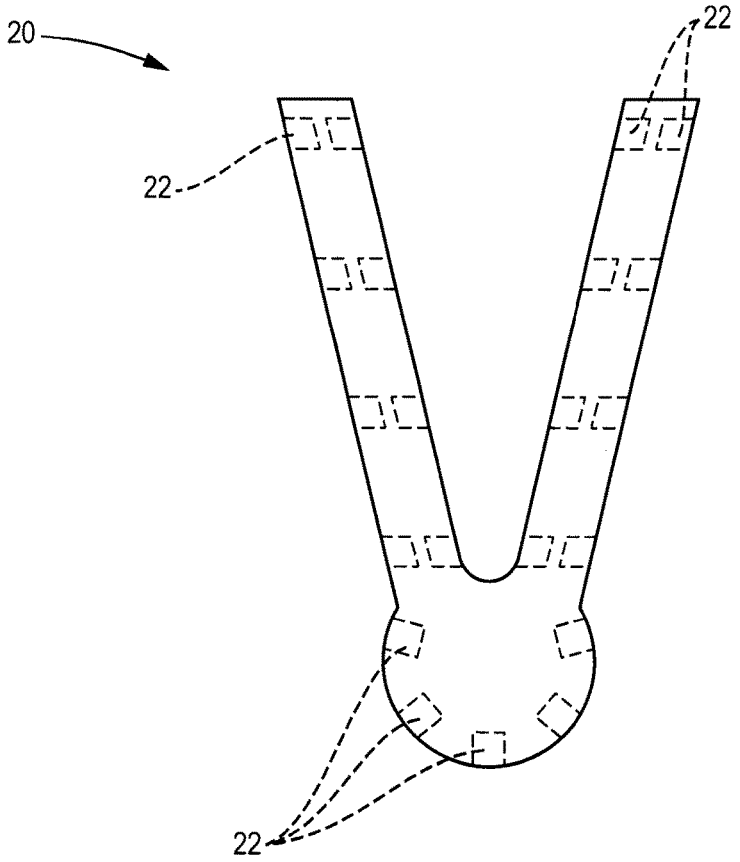
FIG. 5 is a front view in elevation and partial phantom of a liner retainer aperture cover according to yet another embodiment of the disclosure.
Figure 6:
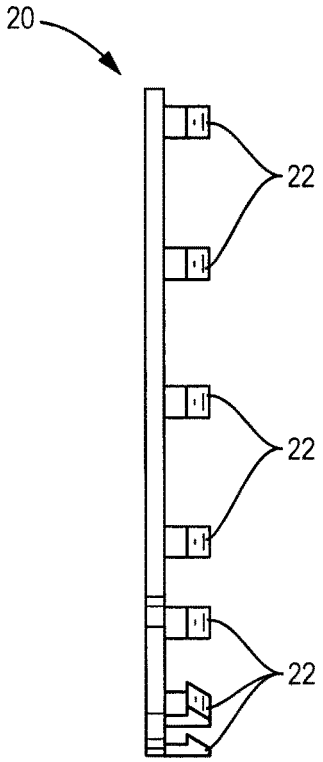
FIG. 6 is a side view in elevation of the liner retainer aperture cover shown in FIG. 5.
Figure 7:
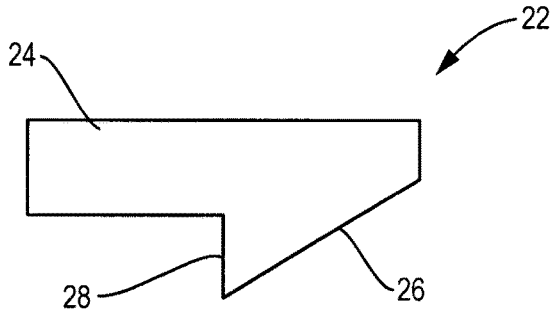
FIG. 7 is top view of a liner retaining aperture cover clip according to the embodiment of the disclosure shown in FIG. 5.

Referring now to FIGS. 5-7, in a yet further aspect of the disclosure, a removable aperture cap, shown generally as 20, conforms to the shape of bag retaining apertures 15 and 15', but with larger dimensions to overlap the aperture edges and register against the outer surface of basket wall 12 (or 12'). A plurality of cover snaps 22 are formed on a bottom of the aperture cap to secure the cap to the basket wall 12. Each snap 22 includes a snap stem 24 that extends substantially orthogonally from a bottom surface of cap 20. An enlarged distal end of stem 24 is formed with a sloped surface 26 and a shoulder 28. Sloped surface 26 is positioned toward the outer edge of aperture cap 20 and registers against the portions of wall 12 (or wall 12') defining aperture 15 (or 15') when cap 20 is urged onto aperture 15. Sloped surface 26 causes stem 24 to flex inwardly relative to aperture 15 until the end of the sloped surface passes the inner surface of wall 12. Stem 24 flexes back to its unstressed position which causes shoulder 28 to register against the inner surface of wall 12. By positioning snaps 22 around the entire bottom surface of cap 20 as shown in FIG. 5, each part of the cap is secured to basket wall 12.

To remove the cap, a thin implement, such as a screwdriver, is inserted between wall 12 and cap 20 to pry the cap off. The flexible nature of the material used to construct snaps 22, such as soft polymers, permits the cap to be urged off the waste basket as the snaps will flex inwardly until shoulders 28 are no longer in registration with wall 12 and the sloped surfaces 26 are now in the field of aperture 15. In an alternative embodiment, a cutaway may be formed on a bottom edge of cap 20 to create a finger grasp point to permit an individual to use a finger to pry cap 20 off the waste basket. To store cap 20 when not in use, a hook may be formed on a back surface of cap 20 to either hook onto the rim of waste basket 10, or to be secured to a hook receiving loop positioned on either the outer surface or inner surface of wall 12 or (12').

Figure 8:
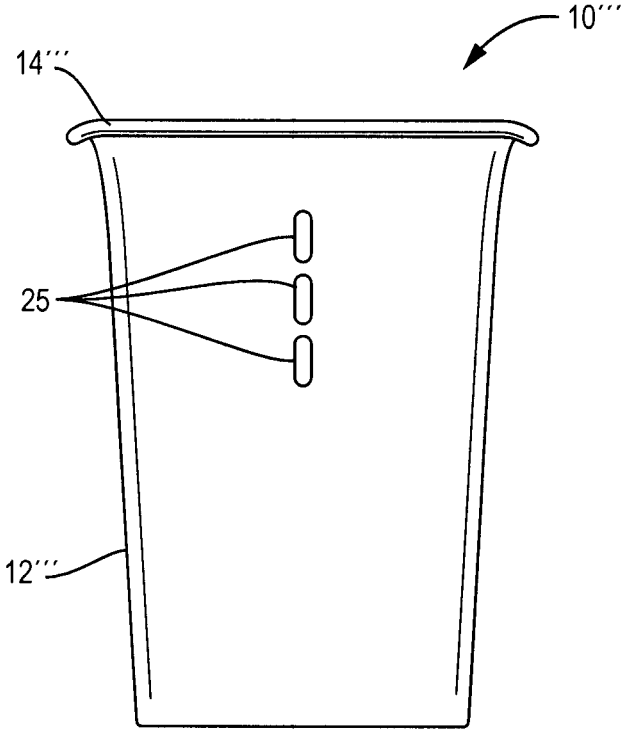
FIG. 8 is a side view in elevation of a waste disposal vessel with aligned imbedded magnets according to a yet further embodiment of the disclosure.
Figure 9:
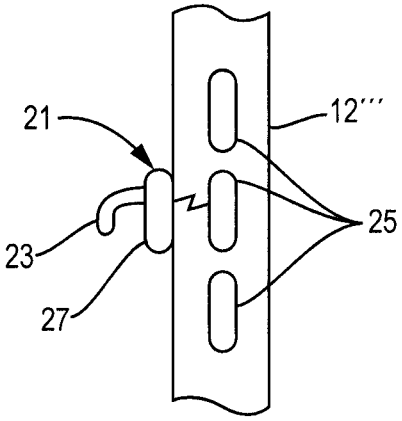
FIG. 9 is a partial cross-sectional view of the waste disposal vessel shown in FIG. 8 with a magnetized hook secured to an outer surface of the disposal vessel wall at the position of a middle magnet.
Figure 10:
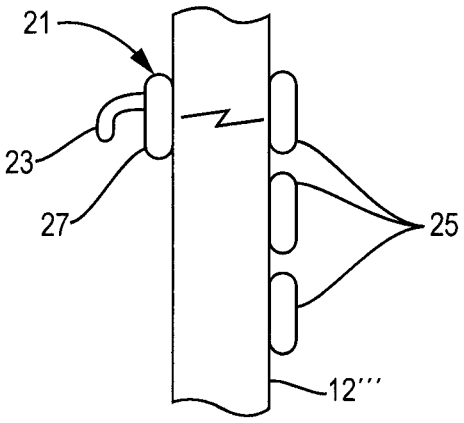
FIG. 10 is a partial cross-sectional view of the waste disposal vessel shown in FIG. 8 with a magnetized hook secured to an outer surface of the disposal vessel wall at the position of a top magnet.
Figure 11:
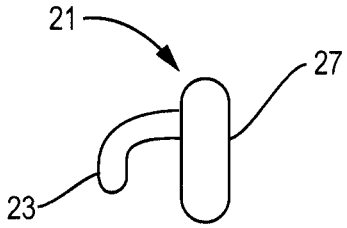
FIG. 11 is a side view of a magnetized hook according to the embodiment of the disclosure shown in FIG. 8.

In another aspect of the disclosure, as shown in FIGS. 8-11, a waste basket container, shown generally as 10''', includes a basket wall 12''' and a waste basket rim 14'''. Secured within (FIG. 9), or on an inner side of (FIG. 10), wall 12''' is one or more magnets 25. Magnets 25 are positioned on opposing sides of waste basket 10''' to provide two attachment points to secure a bag liner. A magnet hook, shown generally as 21, includes a magnetized hook base 27 and a hook 23 extending from the base. Hook 23 faces downwardly relative to the upright orientation of waste basket 10'''. To secure a bag liner to waste basket 10''', magnet hook 21 is positioned adjacent to a selected magnet 25. Multiple magnets 25 may be provided and aligned substantially vertically and substantially in parallel to a vertical axis of waste basket 10''' as shown in FIGS. 8-10 to provide variation to the location of magnet hook 21. This permits the assembly to accommodate differently sized bag liners. For larger bag liners, magnet hook 21 is positioned on a lower or lower most magnet so that a larger portion of the bag is extended over the outer wall of the waste basket. For smaller bags, magnet hook 21 is placed adjacent to a higher or highest magnet 25 so that less of the bag is positioned on the outer surface of the waste basket wall. This enables a user to customize the bag liner orientation so that the bottom of the liner bag is positioned adjacent to a bottom of the waste basket and the basket rim remains fully covered by the liner bag.

To use this embodiment, a user takes either the handles of a plastic bag, or grasps a portion of the bag top edge and secures it to the downward facing hook 23 on either side of waste basket 10'''. Any force generated on the bag when refuse is placed in the waste basket will tighten the registration of the liner bag handles or bag edge to the hook. To release the bag from hooks 23, a user simply urges the bag handles or bag edge off the hook and pulls the filled liner bag out of waste basket 10'''. Because magnet hook 21 can be selectively placed on container 10''', this embodiment is also advantageous with respect to nesting same-sized waste basket containers.

Referring now to FIGS. 13-18, in a further aspect of the disclosure, a waste basket, shown generally as $\mathbf{10}^{V}$, includes a basket wall $\mathbf{12}^{V}$ and a waste basket rim $\mathbf{14}^{V}$. At least two bag retaining apertures $\mathbf{18}^{V}$ are formed on opposing sides of waste basket $\mathbf{10}^{V}$ to provide two anchor points for a liner bag secured to the waste basket. Apertures $\mathbf{18}^{V}$ can be formed in any shape, but a circular or ovoid shape eliminates any catch or pinch points to facilitate insertion or removal of plastic liner bag sections into and out of the aperture. Unlike the embodiment shown in FIG. 1, rather than use two converging slots to secure a liner bag, the embodiment shown in FIGS. 12-18 use a retractable aperture cover 40 to create a clamping force on the portion of the liner bag that registers against the upper edge of aperture $\mathbf{18}^{V}$. Cover 40 is formed with a top surface side walls and a bottom surface defined by the borders of the sidewalls. A leading edge 41 of cover 40 (the end that exposes the aperture when the cover is retracted) may have the side wall removed to function as a bag receiving slot when a liner bag is secured to the waste basket container.

Figure 17:
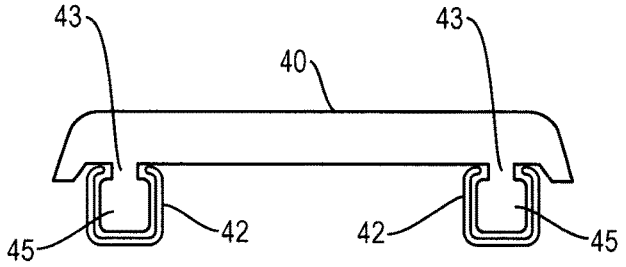
FIG. 17 is a top partial sectional view of the retractable aperture cover assembly shown in FIG. 13.
Figure 18:
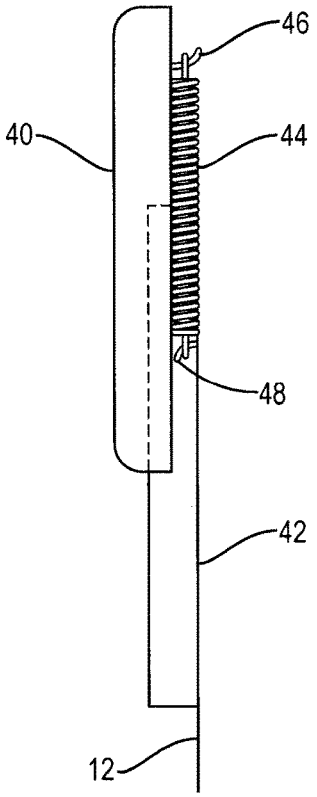
FIG. 18 is a side view in partial phantom of the retractable aperture cover assembly shown in FIG. 17 in a retracted position.

As shown in FIGS. 17 and 18, cover 40 is secured to waste basket $\mathbf{10}^{V}$ with a pair of substantially parallel rails 45 appended to the cover with a pair of rail posts 43. A pair of T-slot channels 42 are dimensioned and positioned on wall $\mathbf{12}^{V}$ to correspond to, and receive, rails 45 such that the rails translate freely within channels 42. The rails and channels are oriented to be substantially parallel with a longitudinal axis of waste basket $\mathbf{10}^{V}$ and may be positioned to retract either upwardly or downwardly. If set to retract upwardly, the rails and channels are positioned above aperture $\mathbf{18}^{V}$. If set to retract downwardly, the rails and channels are positioned below aperture $\mathbf{18}^{V}$. It should be understood that the configuration with the rails formed on, secured to, the cover and the channels formed on, secured to, the waste basket can be reversed. The rails can be formed on, or secured to, the waste basket and the channels formed on, or secured to, the cover.

To maintain cover 40 on and in channels 42 in a closed position (covering aperture $\mathbf{18}^{V}$, a tension spring 44 is used. A first end of the spring is secured to a cover spring attachment hook 46 formed on, or secured to, a bottom side of cover 40. A second end of spring 44 is secured to a wall spring attachment hook 48 formed on or secured to an outer surface of wall 12 between channels 42. In an alternative embodiment, two springs spaced substantially equally between or outside of channels 42 may be used to secure cover 40 to wall 12. It should be understood that any structure or method known in the art to permit the free translation of cover 40 along channels 42 and return of the cover to the closed position may be used. Moreover, stops may be built into the channels and/or rails to limit the travel of cover 40 relative to aperture $\mathbf{18}^{V}$.

Figure 13:
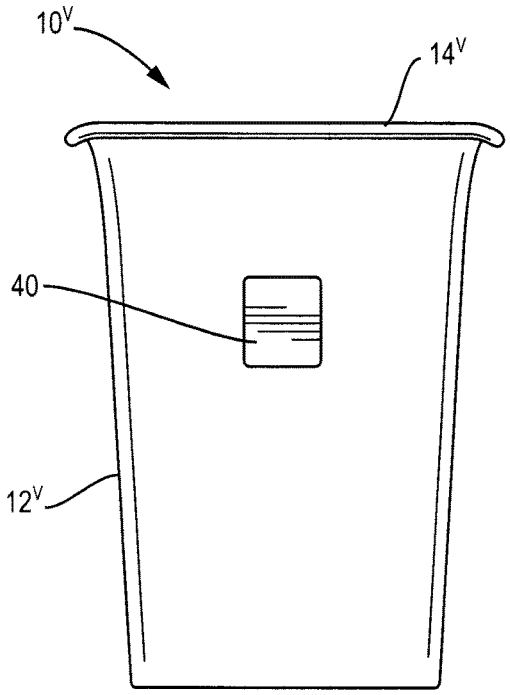
FIG. 13 is a side view in elevation of a waste disposal vessel with a retractable aperture cover according to another embodiment of the disclosure.
Figure 14:
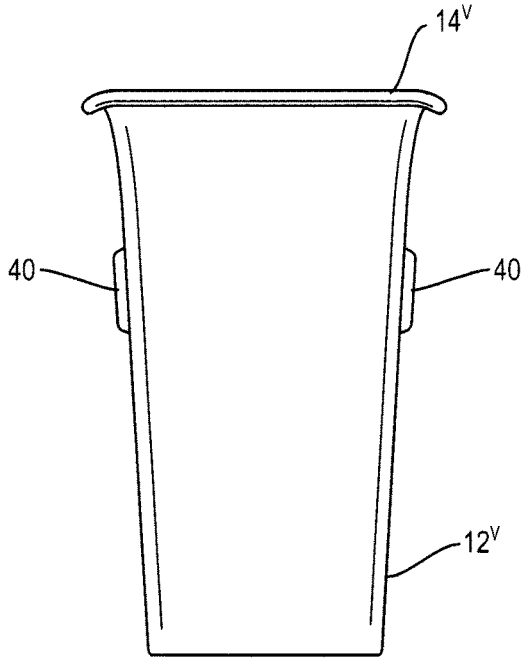
FIG. 14 is a front view in elevation of a waste disposal vessel with retractable aperture covers according to the embodiment shown in FIG. 13.
Figure 15:
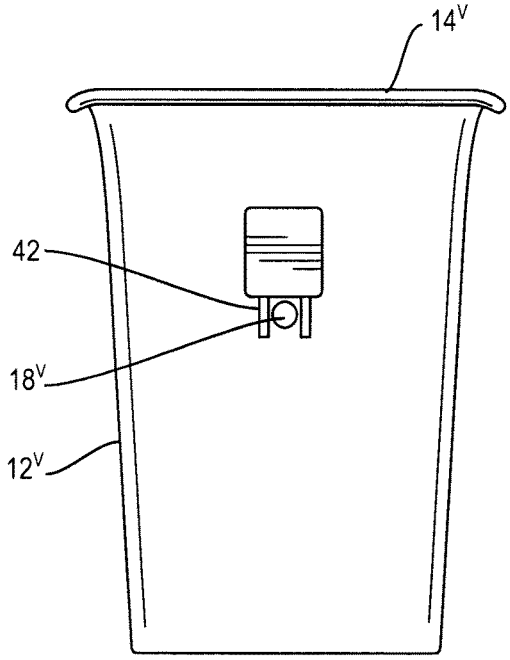
FIG. 15 is a side view in elevation of the waste disposal vessel shown in FIG. 13 with the retractable aperture cover retracted.
Figure 16:
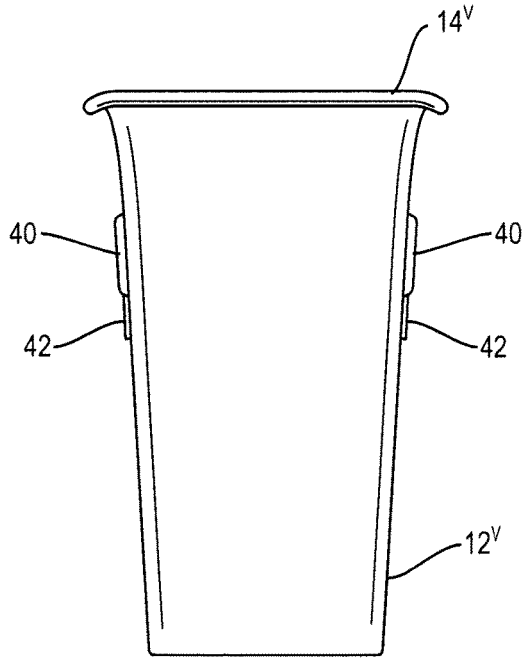
FIG. 16 is a front view in elevation of the waste disposal vessel shown in FIG. 13 with the retractable aperture covers retracted.

To operate cover 40, the user grasps the cover and applies a force to stretch spring(s) 44 to expose aperture $\mathbf{18}^{V}$. The user next takes either a plastic bag handle or a portion of a plastic bag edge and inserts it into aperture $\mathbf{18}^{V}$ while holding cover 40 in a retracted position such as shown in FIGS. 15 and 16. Once the selected bag component is secured in the aperture, the user releases cover 40 or reduces the holding pressure used to permit spring 44 to return cover 40 back to its start or closed position over aperture $\mathbf{18}^{V}$ as shown in FIGS. 13 and 14. A leading edge of cover 40 (with or without the sidewall cutout) will register against a portion of the secured bag so that the bag follows a tortuous path over the cover edge and up through the aperture. This arrangement secures the bag in the slot until intentionally removed. To remove the bag, the user simply retracts each cover 40, one at a time and pulls the trapped bag component out of aperture $\mathbf{18}^{V}$. The bag can now freely be removed from waste basket $\mathbf{10}^{V}$ for disposal.

Figure 19:
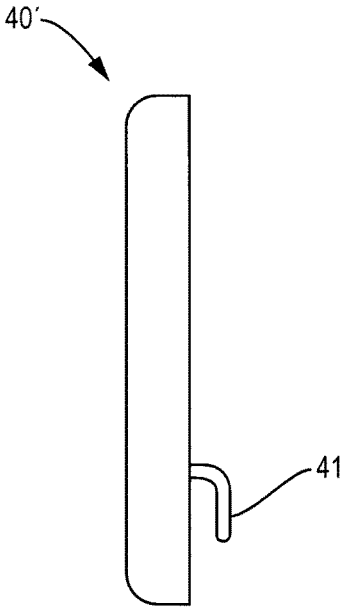
FIG. 19 is a side view in elevation of a retractable aperture cover with an internal hook according to a still further embodiment of the disclosure.
Figure 20:
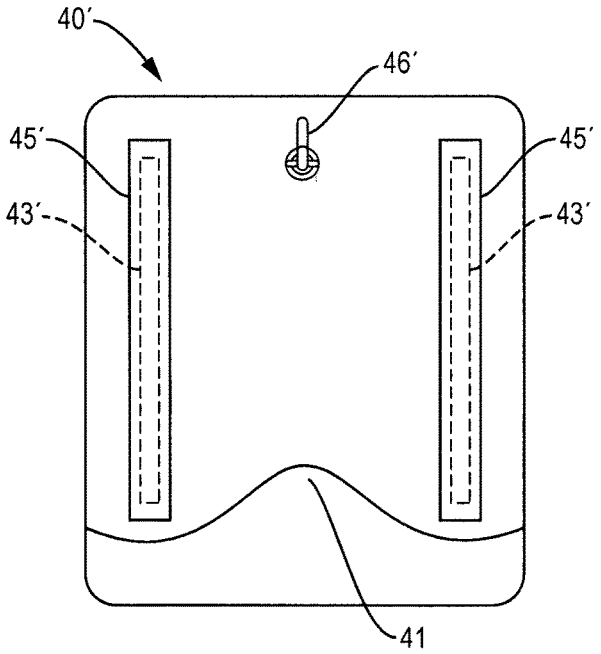
FIG. 20 is a back view in elevation of the retractable aperture cover shown in FIG. 19.

In an alternative embodiment of the cover, as shown in FIGS. 19-22, a cover 40' is formed with a cover hook 41 positioned on a back side of cover 40'. The Hook 41 may face downwardly as shown in FIG. 19, or may face upwardly as shown in FIG. 20. Each orientation will permit the hook to positively engage and hold a liner bag component secured to the cover/hook combination over the aperture. Like the embodiment shown in FIGS. 13-18, cover 40' may be positioned to retract either upwardly from the aperture or downwardly from the aperture. Hook 41 is positioned on cover 40' so as to reside within aperture 18 throughout the entire range of travel of cover 40' as shown in FIG. 22. In this regard, aperture 18 may be elongated as shown in FIG. 21 to accommodate the full travel of cover 40'.

Figure 23:
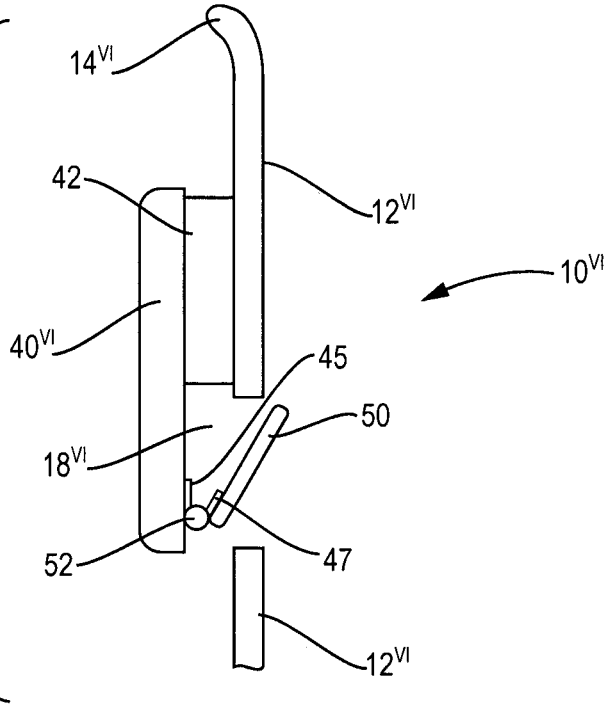
FIG. 23 is a side view in elevation of an upwardly retractable aperture cover with a spring actuated bag retention tab according to a still further embodiment of the disclosure.

In a still further aspect of the disclosure, as shown in FIGS. 23-28, a waste basket, shown in a sectional view generally as $\mathbf{10}^{VI}$, includes a waste basket wall $\mathbf{12}^{VI}$, a waste basket rim $\mathbf{14}^{VI}$, a liner bag retaining aperture $\mathbf{18}^{VI}$, and a retractable cover $\mathbf{40}^{VI}$ with a rotatable bag liner retention tab 50 secured to cover $\mathbf{40}^{VI}$. Tab 50 is secured to a bottom surface of cover $\mathbf{40}^{VI}$ with a hinge 43 and tab spring 52. Retention tab 50 is secured to cover $\mathbf{40}^{VI}$ with one or more hinges 43, or hinge equivalent such as a reduced thickness section between cover $\mathbf{40}^{VI}$ and tab 50. Each hinge 43 includes hinge halves or leafs, each hinge half or leaf dedicated to either the cover or the tab, with each hinge half having one or more cylindrical knuckles formed thereon. Each hinge half is secured to its respective component (cover or tab) with the knuckles aligned in an alternating manner such as with a conventional door hinge, with a pin securing the hinge halves together. Tab spring 52 may be a torsion spring with each end secured to a different component. One spring end 45 is secured to a back side of cover $\mathbf{40}^{VI}$ and a second end 47 is secured to a bottom edge of retention tab 50. The spring is oriented orthogonal to the travel direction of cover $\mathbf{40}^{VI}$. Tab spring 52 is aligned with the axis of the hinge and may register against the aligned and connected hinge knuckles. Torsion spring 52 is configured to maintain the tab in a folded condition relative to cover $\mathbf{40}^{VI}$ as shown in FIG. 23 when cover $\mathbf{40}^{VI}$ is in a closed position.

Figure 28:
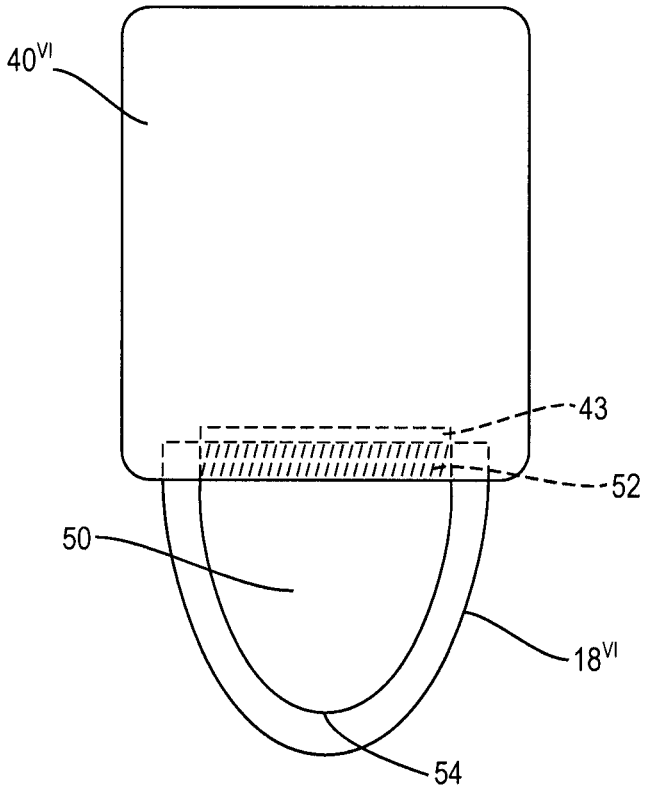
FIG. 28 is a front view in partial phantom of the retractable aperture cover shown in FIG. 23 with the bag retention tab fully extended.
Figure 29:
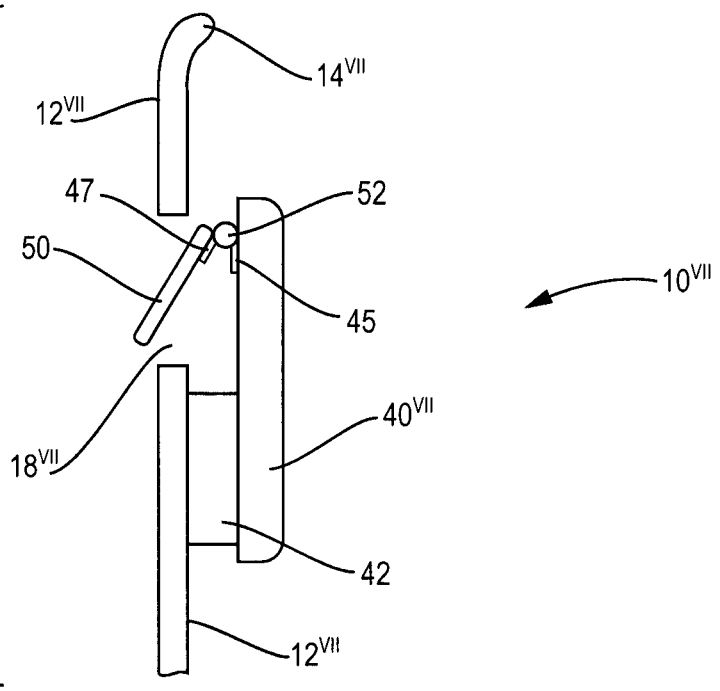
FIG. 29 is a side view in elevation of a downwardly retractable aperture cover with a spring actuated bag retention tab according to a still further embodiment of the disclosure.
Figure 34:
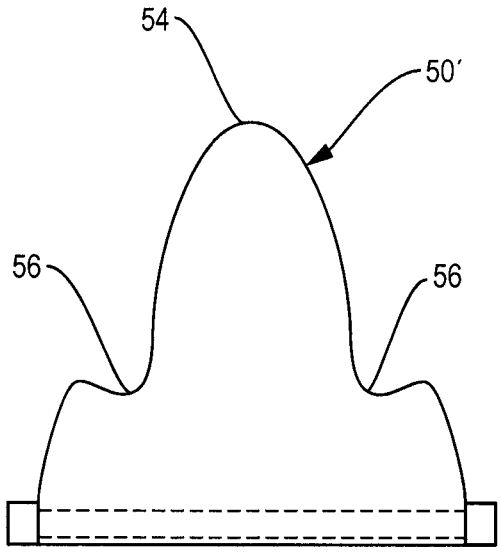
FIG. 34 is a front view in partial phantom of a bag retention tab with a single stepped edge according to one embodiment of the disclosure.

As shown in FIG. 28, retention tab 50 may be formed with a tapered, sloping tip 54 to present an apical surface with which to secure a portion of a liner bag. Tab 50 may also be formed with a stepped edge 56 as shown in FIG. 34 to provide additional points and bar retention surfaces to positively secure portions of the liner bag to waste basket $\mathbf{10}^{VI}$. Each stepped edge may be formed with a raised lateral edge to form a swale in cross-section to better secure a portion of a liner bag.

Figure 36:
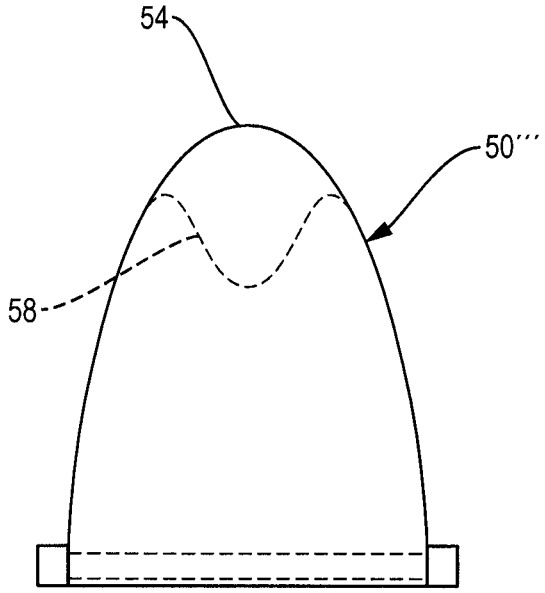
FIG. 36 is a front view in partial phantom of a bag retention tab with a hook formed on an inside surface proximal to an apex of the tab according to a further embodiment of the disclosure.
Figure 37:
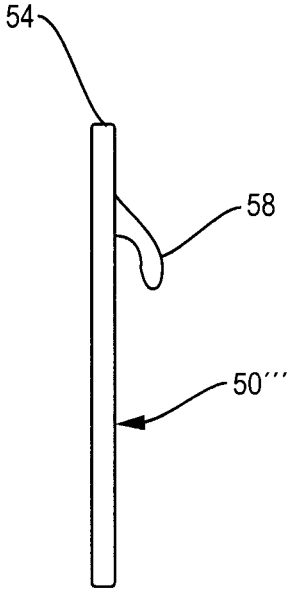
FIG. 37 is a side view of the bag retention tab shown in FIG. 36.

As shown in FIGS. 36 and 37, retention tab 50 may also be formed with a tab hook 58 formed on an inner surface of the tab which faces a center of the waste basket container. Tab hook 58 faces downwardly relative to tab tip 54. When tab 50 is in an extended position, hook 58 faces inwardly relative to the waste container and provides an additional structural attachment of a portion of a liner bag.

Figure 24:
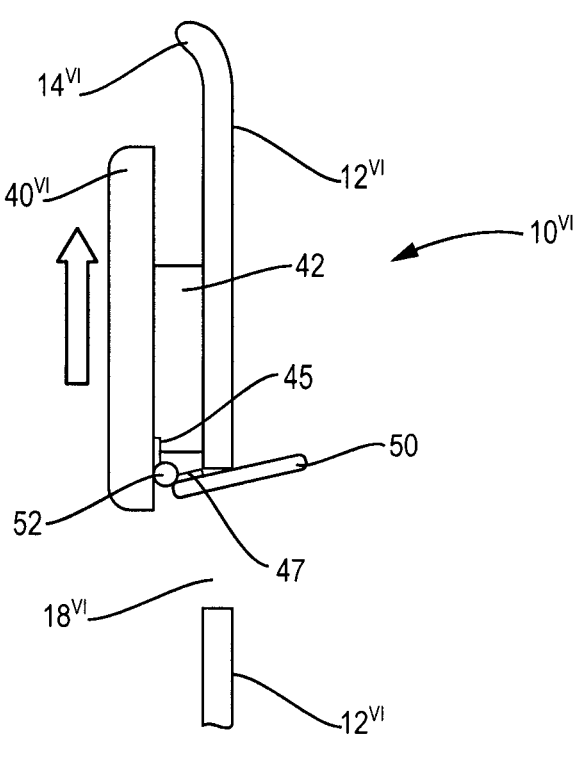
FIG. 24 is a side view in elevation of the retractable aperture cover shown in FIG. 23 partially retracted.
Figure 25:
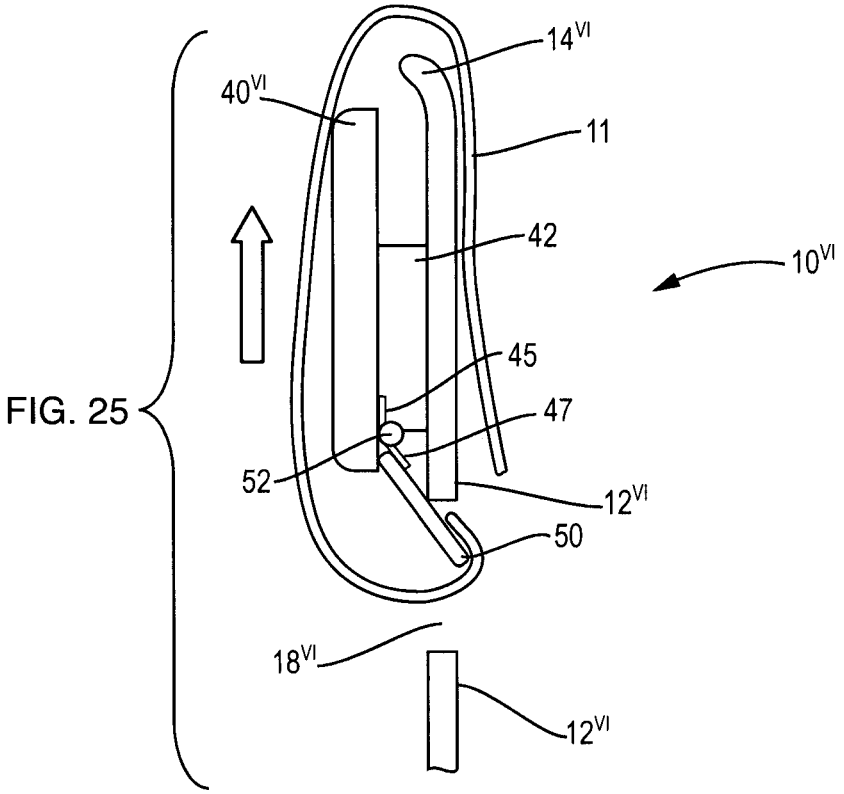
FIG. 25 is a side view in elevation of the retractable aperture cover shown in FIG. 23 fully retracted with a liner bag engaged by the bag retention tab.
Figure 26:
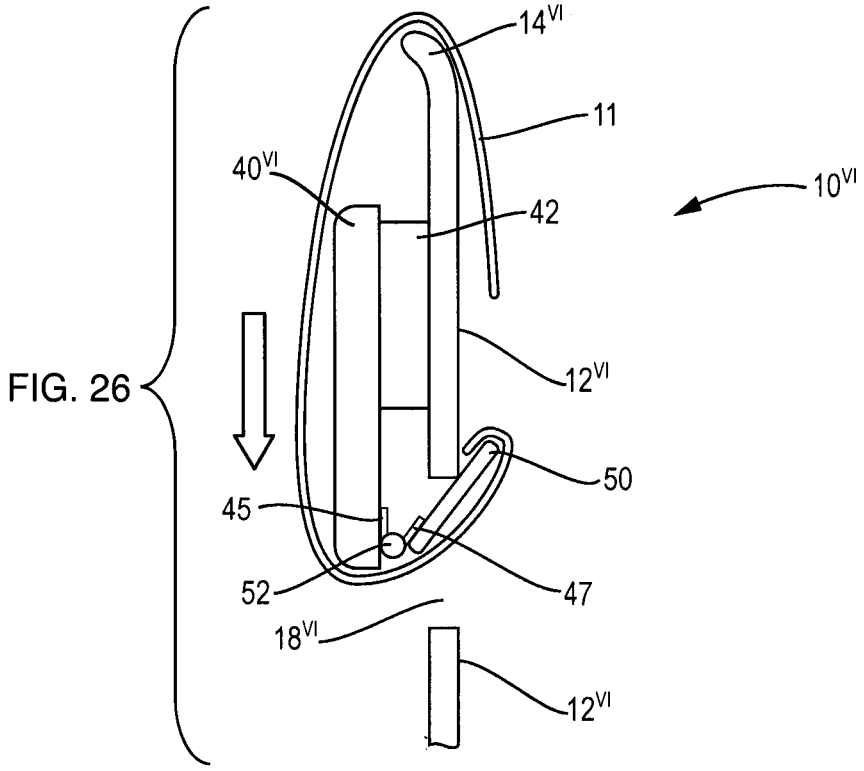
FIG. 26 is a side view in elevation of the retractable aperture cover shown in FIG. 23 partially returned to a closed position with a liner bag engaged to the bag retention tab.
Figure 27:
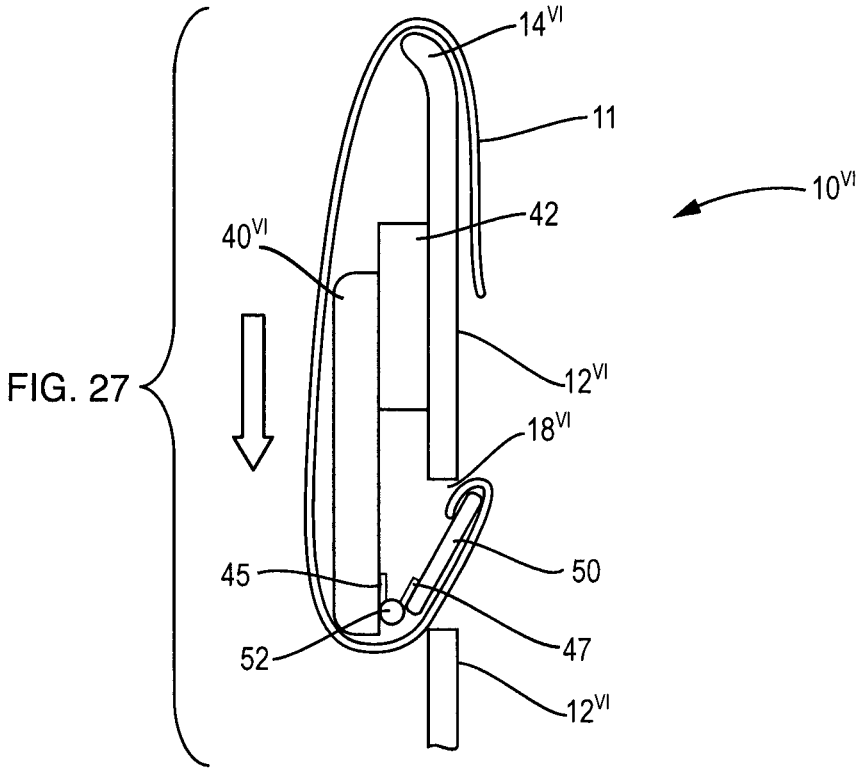
FIG. 27 is a side view in elevation of the retractable aperture cover shown in FIG. 23 with the cover fully closed and a liner bag engaged to the bag retention tab.

To secure a liner bag 11 to waste basket container $\mathbf{10}^{VI}$, a user retracts cover $\mathbf{40}^{VI}$ upwardly toward rim $\mathbf{14}^{VI}$. As the cover slides along the rail/slot combinations, an inner surface of tab 50 registers against, and translates along, the portion of wall $\mathbf{12}^{VI}$ that defines an upper edge of aperture $18^{VI}$. The further cover $40^{VI}$ is retracted the more tab 50 rotates about its hinged base and slides along the edge of the aperture as shown in FIG. 24 until full retraction as shown in FIG. 25. At its fully extended position, tab 50 is positioned such that a gap remains between the tab and aperture $18^{VI}$ (as shown in FIG. 28), to enable a user to insert a portion of a bag liner into the aperture and over the tab. At this point, the user inserts a portion of liner bag 11 into aperture $18^{VI}$ and over tab tip 50. The user next releases cover $40^{VI}$ or reduces the pressure on the cover which permits the cover to return to the closed positon and permits tab 50 to rotate back to its original position with the force applied by tab spring 52 as shown in FIG. 26 (partial return) and FIG. 27 (complete return). If cover $40^{VI}$ is formed with a leading edge slot, the liner bag will collect within the slot and follow the tortuous path around tab 50 to positively lock liner bag 11 in place. The cover slot can also permit easier access to tab 50 and allow further rotation of the tab toward a substantially vertical orientation relative to the upright orientation of the waste basket container.

Figure 35:
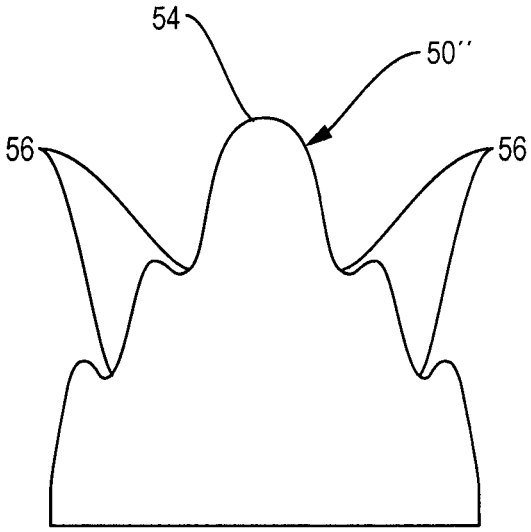
FIG. 35 is a front view in partial phantom of a bag retention tab with a multiple stepped edge according to another embodiment of the disclosure.

If tab 50 includes one or more steps such as shown in FIGS. 34 and 35, portions of the liner bag become lodged on the steps to further secure the liner bag. If a tab hook 58 is present, the hook engages portions of the liner bag to further secure the liner bag in aperture $18^{VI}$. It should be understood that tab 50 may be formed with both edge steps and one or more tab hooks to increase bag retention surfaces.

To release liner bag 11 from waste basket container $50^{VI}$, cover $40^{VI}$ is retracted upwardly until tab 50 rotates fully downwardly to its fully extended position. The user then pulls the portions of liner bag 11 registered against tab 50 off the tab. Cover $40^{VI}$ is released or pressure is reduced on the cover to allow cover $40^{VI}$ to return to the closed position. Liner bag 11 can now be lifted out of waste basket container $10^{VI}$ and disposed.

Referring now to FIGS. 29-33, in a yet further aspect of the disclosure, a waste basket, shown in a sectional view generally as $10^{VI}$, includes a waste basket wall $12^{VIII}$, a waste basket rim $14^{VII}$, a liner bag retaining aperture $18^{VII}$, and a retractable cover $40^{VII}$ with a rotatable bag liner retention tab 50 secured to cover $40^{VII}$. Tab 50 is secured to a bottom surface of cover $40^{VII}$ with a hinge 43 and tab spring 52. Retention tab 50 is secured to cover $40^{VII}$ with one or more hinges 43, or hinge equivalent such as a reduced thickness flexible section formed between cover $40^{VIII}$ and tab 50 such as in a single mold used to make both the cover and the tab as a single flexible unit. Each hinge 43 includes hinge halves or leafs, each hinge half or leaf dedicated to either the cover or the tab, with each hinge half having one or more cylindrical knuckles formed thereon. Each hinge half is secured to its respective component (cover or tab) with the knuckles aligned in an alternating manner such as with a conventional door hinge, with a pin securing the hinge halves together. Alternatively, tab 50 may be secured to cover $40^{VII}$ solely with tab spring 52. Tab spring 52 may be a torsion spring with each end secured to a different component. One spring end 45 is secured to a back side of cover $40^{VII}$ and a second end 47 is secured to a bottom edge of retention tab 50. The spring is oriented orthogonal to the travel direction of cover $40^{VII}$. Tab spring 52 is aligned with the axis of the hinge and may register against the aligned and connected hinge knuckles. Torsion spring 52 is configured to maintain the tab in a folded condition relative to cover $40^{VII}$ as shown in FIG. 23 when cover $40^{VII}$ is in a closed position.

In the same manner as shown for waste basket container $10^{VI}$ in FIG. 28, retention tab 50 may be formed with a tapered, sloping tip 54 to present an apical surface with which to secure a portion of a liner bag. Tab 50 may also be formed with a stepped edge 56 as shown in FIG. 34 to provide additional points and bar retention surfaces to positively secure portions of the liner bag to waste basket $10^{VII}$. Each stepped edge may be formed with a raised edge to form a swale in cross-section to better secure a portion of a liner bag.

As shown in FIGS. 36 and 37, retention tab 50 may also be formed with a tab hook 58 formed on an inner surface of the tab which faces a center of the waste basket container. Tab hook 58 faces downwardly relative to tab tip 54. When tab 50 is in an extended position, hook 58 faces inwardly relative to the waste container and provides an additional structural attachment of a portion of a liner bag.

Figure 30:
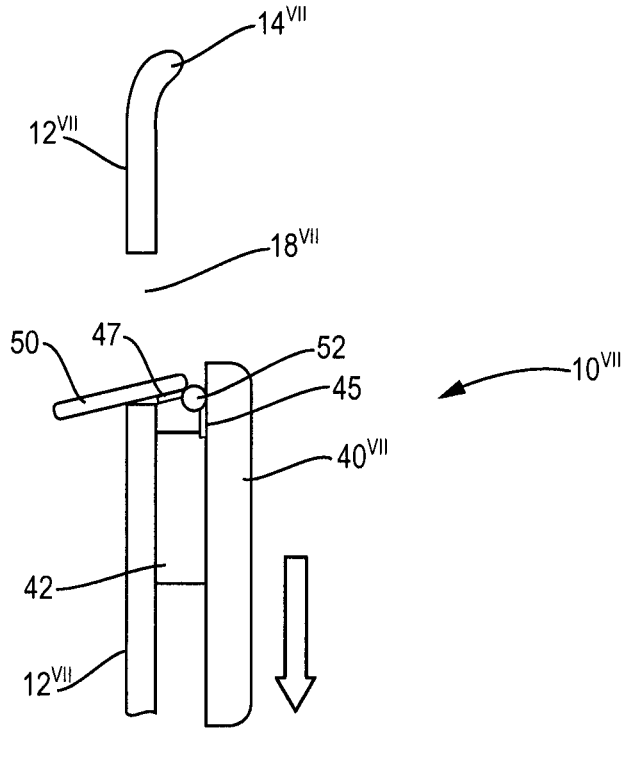
FIG. 30 is a side view in elevation of the retractable aperture cover shown in FIG. 29 partially retracted.
Figure 31:
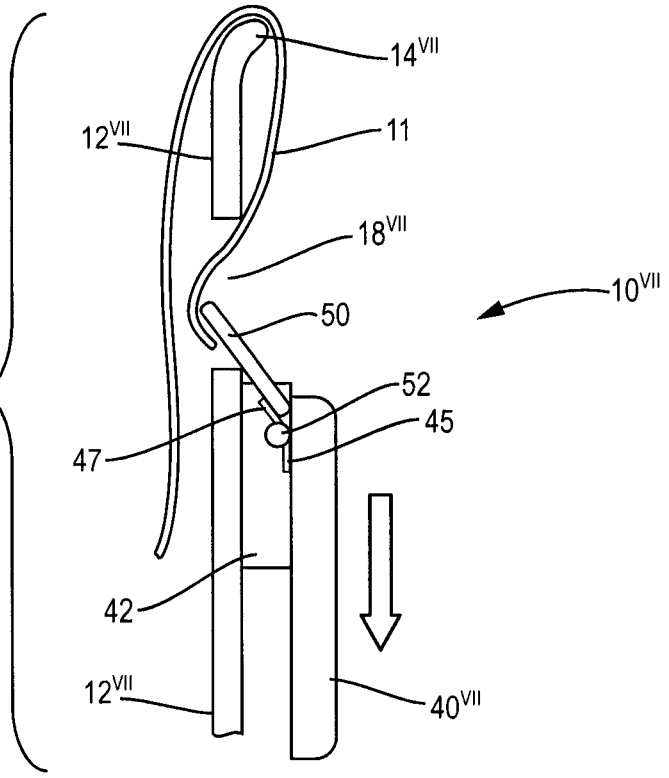
FIG. 31 is a side view in elevation of the retractable aperture cover shown in FIG. 29 fully retracted with a liner bag engaged by the bag retention tab.
Figure 32:
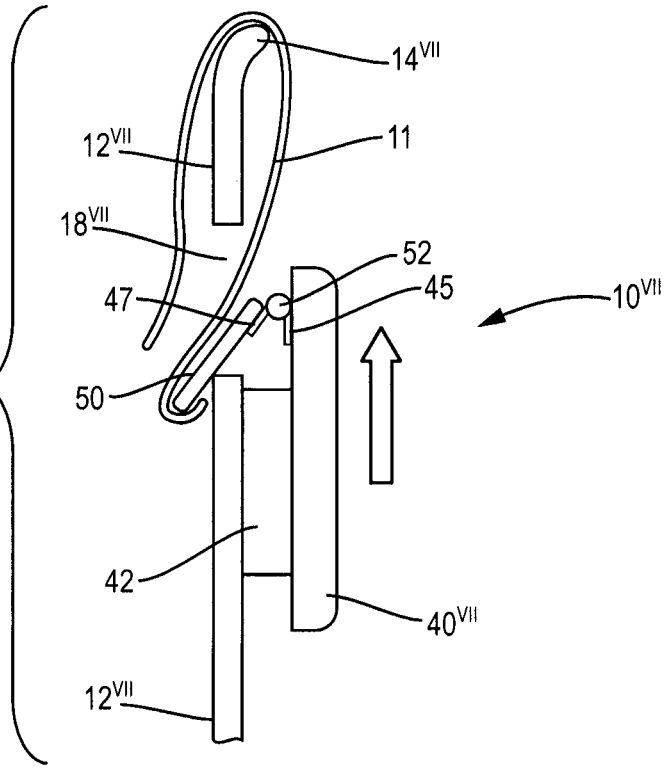
FIG. 32 is a side view in elevation of the retractable aperture cover shown in FIG. 29 partially returned to a closed position with a liner bag engaged to the bag retention tab.
Figure 33:
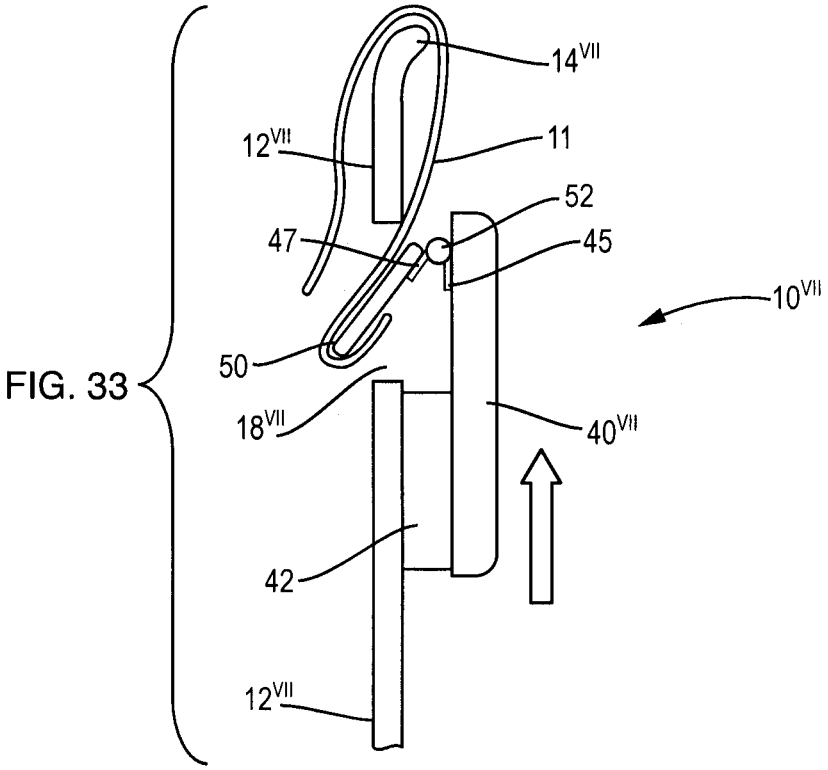
FIG. 33 is a side view in elevation of the retractable aperture cover shown in FIG. 29 with the cover fully closed and a liner bag engaged to the bag retention tab.

To secure a liner bag 11 to waste basket container $10^{VI}$, a user retracts cover $40^{VII}$ downwardly away from rim $14^{VII}$. As the cover slides along the rail/slot combinations, an inner surface of tab 50 registers against the portion of wall $12^{VII}$ that defines an upper edge of aperture $18^{VII}$. The further cover $40^{VII}$ is retracted the more tab 50 rotates about its hinged base and slides along the edge of the aperture as shown in FIG. 30 until full retraction as shown in FIG. 31. At its fully extended position, tab 50 is positioned such that a gap remains between the tab and aperture $18^{VI}$ (as shown in FIG. 28), to enable a user to insert a portion of a bag liner into the aperture and over the tab. At this point, the user inserts a portion of liner bag 11 into aperture $18^{VII}$ and over tab tip 50. The user next releases cover $40^{VII}$ or reduces the pressure on the cover which permits the cover to return to the closed positon and permits tab 50 to rotate back to its original position with the force applied by tab spring 52 as shown in FIG. 32 (partial return) and FIG. 33 (complete return). If cover $40^{VII}$ is formed with a leading edge slot, the liner bag will collect within the slot and follow the tortuous path around tab 50 to positively lock liner bag 11 in place. The cover slot can also permit easier access to tab 50 and allow further rotation of the tab toward a substantially vertical orientation relative to the upright orientation of the waste basket container.

If tab 50 includes one or more steps such as shown in FIGS. 34 and 35, portions of the liner bag become lodged on the steps to further secure the liner bag. If a tab hook 58 is present, the hook engages portions of the liner bag to further secure the liner bag in aperture $18^{VI}$. It should be understood that tab 50 may be formed with both edge steps and one or more tab hooks to increase bag retention surfaces.

To release liner bag 11 from waste basket container $10^{VII}$, cover $40^{VII}$ is retracted downwardly until tab 50 is in its fully extended position. The user then pulls the portions of liner bag 11 registered against tab 50 off the tab. Cover $40^{VII}$ is released or pressure is reduced on the cover to allow cover $40^{VII}$ to return to the closed position. Liner bag 11 can now be lifted out of waste basket container $10^{VII}$ and disposed.

Figure 38:
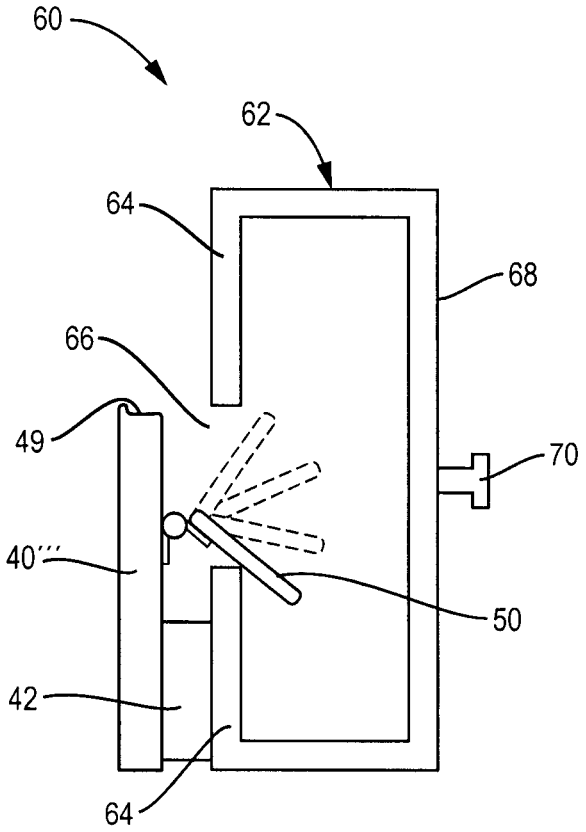
FIG. 38 is a side view in elevation of a liner bag retention module according to a further embodiment of the disclosure.
Figure 39:
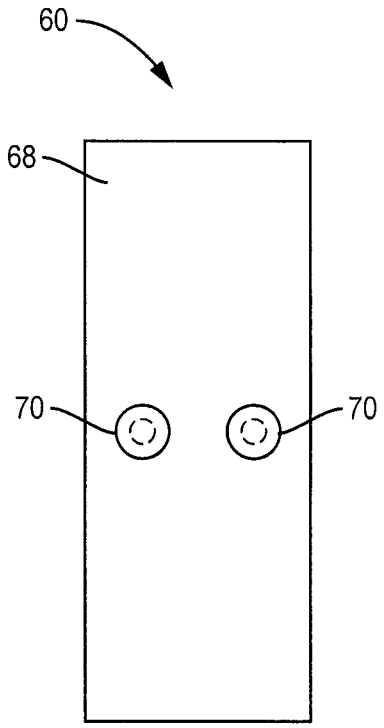
FIG. 39 is a back view in elevation of the retention module shown in FIG. 38.
Figure 40:
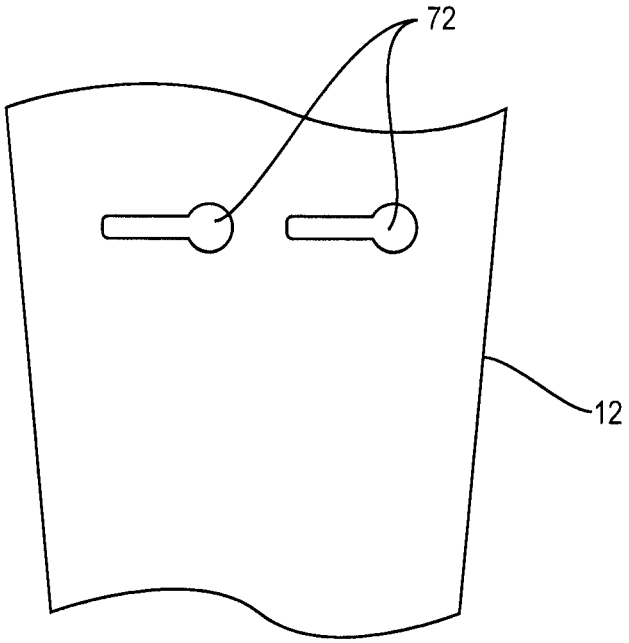
FIG. 40 is a front partial view of a waste basket container with module receiving slots according to the embodiment of the disclosure shown in FIG. 38.
Figure 43:
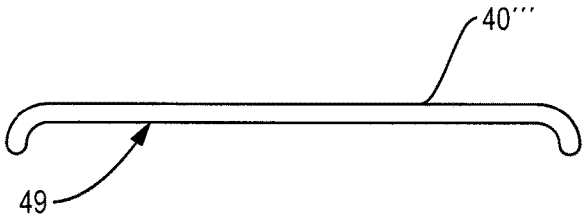
FIG. 43 is an end view of a liner bag retention module cover with a slot formed in a leading edge according to the embodiment of the disclosure shown in FIG. 38.

In another aspect of the disclosure, the liner bag retention apparatus shown in FIGS. 29-33 may be configured as a modular unit attachable to a partially modified or unmodified waste basket container. As shown in FIGS. 38-40, in one embodiment, a liner bag retention module shown generally as 60, includes a tab retaining capsule 62 dimensioned to permit rotation of tab 50 within the capsule. A top side 64 of capsule 62 defines a liner bag retention aperture 66 dimensioned to expose tab 50 when extended. Top side 64 also includes either rails 45 or T-slot channels 42 to correspond with T-slot channels or rails disposed on a bottom of cover 40''', the same as those disclosed for cover 40. In form and function, top side 64 with aperture 66 is equivalent to wall 12, wall 12', wall $12^{VI}$, etc., that define bag retention apertures 15, or 18$^{VI}$ and include rail or T-slot combinations that are secured to the cover as disclosed herein. Cover 40''' may be formed with a leading-edge slot 49 as shown in FIG. 43.

Figure 41:
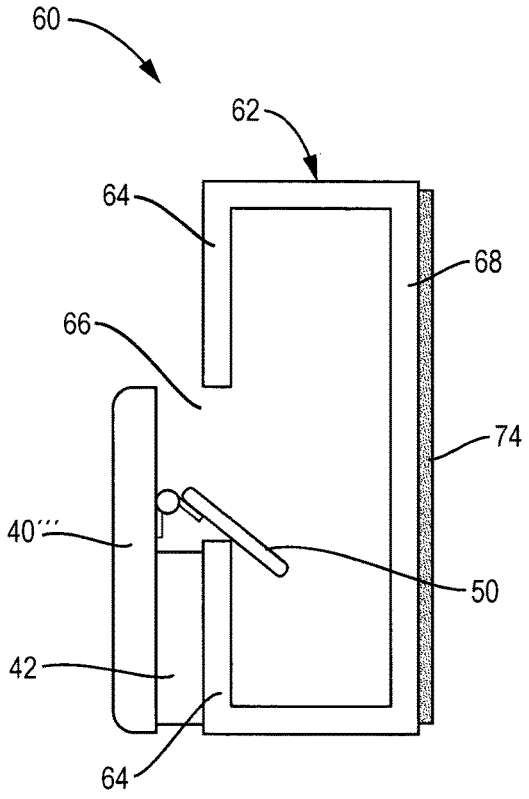
FIG. 41 is a side view in elevation of a liner bag retention module according to a still further embodiment of the disclosure.
Figure 42:
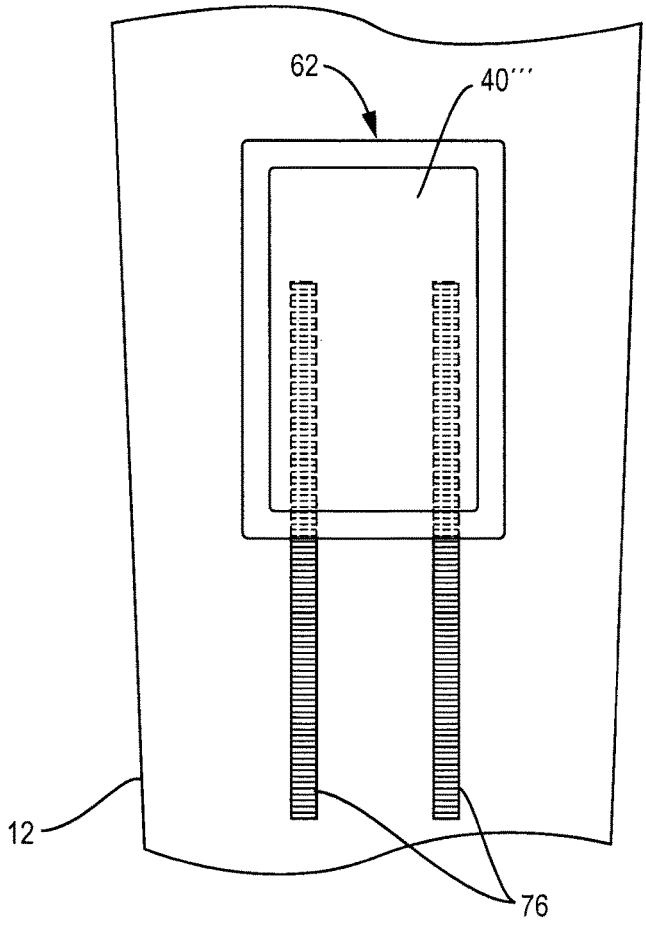
FIG. 42 is a front view in elevation of a liner bag retention module secured to a waste basket container on adjustable rails according to yet another embodiment of the disclosure.

A bottom side 68 of capsule 62 may be formed with locking studs 70 dimensioned and structured to be secured in key hole apertures 72 formed in a waste basket container wall as shown in FIG. 40. The locking studs are inserted into the large circular portions of the key holes and slid to register within the smaller diameter slots of the key holes to lock capsule 60 to the waste basket container. Key hole apertures 72 may be aligned horizontally, orthogonal relative to a longitudinal axis of the waste basket container to properly anchor capsule 60 for vertical movement of cover 40'''. It should be understood that other orientations of the stud/key hole assemblies may be used to secure capsule 62 to a waste basket container. Ideally, at least two capsules are secured to opposing sides of a waste basket container to secure a liner bag. In an alternative embodiment shown in FIG. 41, bottom side 64 is covered with an adhesive backing or adhesive tape 74 to permit capsule 60 to be adhered to a side of a waste basket container. This eliminates the need to create key holes in the waste basket or the need for locking studs to secure the capsule to the waste basket container. Liner bag retention module 60 may also be placed on corrugated rails 76 secured to the waste basket container with detents or pawls as commonly known in the art to permit adjustment of the modules along the longitudinal axis of the waste basket container to accommodate differently sized liner bags as shown in FIG. 42. To use capsule 60, the same use procedure disclosed for cover 40 of waste basket container 10$^{VI}$ is used for cover 40'''.

Referring now to FIGS. 45-50, in a still further aspect of the disclosure, a waste basket container, shown generally as 10$^{VIII}$, includes a waste basket wall 12 with a flanged waste basket rim 14 formed on a top end of the wall. The wall may be a continuous circular or ovoid shape in cross-section, may be multi-sided such as square or rectangular, or may conform to any regular or irregular geometric shape in cross-section. Regardless of the wall shape, the continuous rim provides a radiused profile that prevents snagging or finger capture points when placing refuse in the container. The radiused rim also provides a smooth edge against which to insert a plastic shopping bag repurposed as a liner in the waste basket.

A pair of slots 80 are formed proximal to the bottom of container 10$^{VIII}$ and diametrically opposed from one another. A pair of hook inserts, shown generally as 82, have portions dimensioned to slide within slots 80 to anchor hook inserts 82 to container 10$^{VIII}$. Hook inserts 82 include a substantially flat and optionally wide hook insert main body 84 with a hook 86 extending from main body 84 proximal a top end of the hook inserts. A bottom end of hook inserts 82 is formed with a transition segment 88 that extends away from main body 84 at an approximately 90° angle relative to the plane occupied by main body 84. It should be understood the angle between transition segment 88 and main body 84 can vary from 90° including +/−45° or more either way. A hook insert locking segment 90 extends downwardly from a distal end of transition segment 88 and is dimensioned to register against the inner surface of wall 12.

To secure hook insert 82 to container wall 12, locking segment 90 is inserted into slot 80 until the junction of locking segment 90 and transition segment 88 register against waste basket wall 12. Once registration is accomplished, hook insert 82 is rotated so that main body 84 registers against waste basket wall 12. Once the combination of transition segment 88 and locking segment 90 is secured in slot 80, hook insert 82 may be secured to waste basket wall 12 in one or several manners. In a first embodiment, a hook and loop system such as Velcro® may be secured proximal to the top end of hook insert 82 and the corresponding point on waste basket wall 12 to secure hook insert 82 to waste basket wall 12. In another embodiment, one or more segments of double-stick tape may be placed between waste basket wall 12 and hook insert 82 proximally to the top end of the hook insert to secure hook insert 82 to wall 12.

In a third embodiment, one or more magnets may be used to secure hook insert 82 to wall 12. One magnet may be attached to, or embedded in, wall 12. If hook insert 82 is metallic, the insert will be bound by the magnet. If hook insert 82 is not metallic, e.g., made from a polymer or generically plastic, a second magnet can be secured to, or embedded in, hook insert 82 and used to register against the first magnet with opposite poles of the magnets oriented to create the magnetic attraction. It should be understood that any means known in the art to secure hook insert 82 to wall 12 may be used and remain within the scope and spirit of the disclosure.

To remove hook insert 82 from waste basket wall 12, the hook insert securing procedure is reversed. First, the sides of hook insert 82 are grasped proximal to the hook insert securing means such as the Velcro®. A force is applied to hook insert 82 to pull the hook insert away from waste basket wall 12. Once the securing means is released, hook insert 82 is rotated until locking segment 90 is horizontal within slot 80 as shown in FIG. 49. Hook insert 82 can then be removed from waste basket wall 12 by pulling hook insert 82 in a horizontal direction out of slot 80.

To secure a wastebasket liner, e.g., a plastic grocery bag, to waste basket container 10$^{VIII}$, the plastic bag is placed inside the container and the open end of the bag is draped over waste basket rim 14. Portions of the open end are secured to the hooks 86 to prevent the bag from falling into the container when waste materials are deposited in the bag. To remove the bag, the portions engaged to the hooks 86 are urged down and away from the hooks to dislodge the bag open end from the hooks. The bag can then be lifted out of container 10$^{VIII}$.

Referring now to FIGS. 51-56, in yet another aspect of the disclosure, a waste basket container, shown generally as 10$^{IX}$, includes a waste basket wall 12' with a flanged waste basket rim 14' formed on a top end of the wall. The wall may be a continuous circular or ovoid shape in cross-section, may be multi-sided such as square or rectangular, or may conform to any regular or irregular geometric shape in cross-section. Regardless of the wall shape, the continuous rim provides a radiused profile that prevents snagging or finger capture points when placing refuse in the container. The radiused rim also provides a smooth edge against which to insert a plastic shopping bag repurposed as a liner in the waste basket.

A pair of slots 80' are formed proximal to the bottom of container 10$^{IX}$ and diametrically opposed from one another. A pair of hook inserts, shown generally as 82', have portions dimensioned to slide within slots 80' to anchor hook inserts 82' to container 10$^{IX}$. Hook inserts 82' include a substantially flat and optionally wide hook insert main body 84' with a hook 86' extending from main body 84' proximal a top end of the hook inserts. A bottom end of hook inserts 82' is formed with a transition segment 88' that extends away from main body 84' at an approximately 90° angle relative to the plane occupied by main body 84'. It should be understood the angle between transition segment 88' and main body 84' can vary from 90° including +/−45° or more either way. A hook insert locking segment 90' extends downwardly from a distal end of transition segment 88' and is dimensioned to register against the inner surface of wall 12'.

A hook insert locking bore 81 is formed in waste basket wall 12' aligned axially with, and above, slot 80' at a point on wall 12' proximal to a top end of hook insert 82' when hook insert 82' is assembled to waste basket container $\mathbf{10}^{IX}$. A hook insert securing knob 92 is formed on, or secured to, a back side of hook insert 82' proximal the top end of the hook insert. Knob 92 is dimensioned to be inserted into locking bore 81 to secure the hook insert to waste basket wall 12. A ball end of knob 92 is dimensioned to be larger than locking bore 81.

To secure hook insert 82' to waste basket wall 12', locking segment 90' is inserted into slot 80' until the junction of locking segment 90' and transition segment 88' register against waste basket wall 12'. Once registration is accomplished, hook insert 82' is rotated so that knob 92 is registered against the perimeter of locking bore 81. By pressing against hook insert 82' from the hook insert front side and directly over the location of knob 92, the ball end of knob 92 is urged past locking bore 81 until the ball end is inside waste basket wall 12' and registered against the inside surface of wall 12'. The releasably locks hook insert 82' to waste basket wall 12'. To remove hook insert 82' from wall 12', the edges of hook insert 82' are grasped at the approximate location of knob 92 and force is applied to pull hook insert 82' away from wall 12'. Application of such a force urges the ball end of knob 92 through the relatively pliable perimeter of locking bore 81 that stretches to permit the exit of knob 92 from locking bore 81. Hook insert 82' is then rotated until locking segment 90' is horizontal within slot 80'. Hook insert 82' can then be removed from waste basket container $\mathbf{10}^{IX}$ by pulling locking segment 90 out of slot 80'.

To secure a wastebasket liner, e.g., a plastic grocery bag, to waste basket container $\mathbf{10}^{IX}$, the plastic bag is placed inside the container and the open end of the bag is draped over waste basket rim 14'. Portions of the open end are secured to the hooks 86' to prevent the bag from falling into the container when waste materials are deposited in the bag. To remove the bag, the portions engaged to the hooks 86' are urged down and away from the hooks to dislodge the bag open end from the hooks. The bag can then be lifted out of container $\mathbf{10}^{IX}$.

All of the embodiments disclosed herein ensure positive engagement of a bag liner such that the entire bag is superposed about the waste basket rim in such a manner that the bag cannot slip off a portion of the rim as is a common occurrence when plastic bags are inserted into waste basket containers as liners and heavy waste materials are placed in the container. Any surface mounted components are structured to have slim profiles to ensure waste baskets can be nested for storage and for sale presentations.

The materials used to make any of the bag liner retention embodiments disclosed herein may be the same as the moldable materials used to make a waste basket. Polymers such as polypropylene, polyethylene may be used to make the hooks, aperture covers and caps disclosed herein. Any suitable polymer known in the art for making plastic articles may be used to make these components. Any springs disclosed herein are made from conventional metals such as spring steel.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A waste basket lining bag securing apparatus comprising:

a container having a container wall with an outer surface and an inner surface having four sides, each side having a bottom end and a top end, a bottom connected to the bottom ends of the four sides and a rim connected to the top ends of the four sides;

at least two lining bag retaining apertures each formed on one of two opposing sides of the container; and, at least two retractable aperture covers secured to the outer surface of the container wall, each positioned over one of the at least two retaining apertures, wherein each aperture cover has a pair of substantially parallel T-slots formed on a bottom surface of each aperture cover, wherein the container has a substantially parallel pair of rails formed either above or below each aperture, and wherein the rails are dimensioned to fit and slide freely within the cover T-slots.

2. The apparatus of claim 1 further comprising at least one aperture cover retaining spring for each aperture cover, wherein a first spring end is secured to the bottom surface of the aperture cover and a second spring end is secured to the container wall proximal to the bag retaining aperture.

3. The apparatus of claim 1 wherein the apertures conform to any regular or irregular geometric shape.

4. A waste basket lining bag securing apparatus comprising:

a container having a container wall with an outer surface and an inner surface having four sides, each side having a bottom end and a top end, a bottom connected to the bottom ends of the four sides and a rim connected to the top ends of the four sides;

at least two lining bag retaining apertures each formed on one of two opposing sides of the container;

at least two retractable aperture covers secured to the outer surface of the container wall, each positioned over one of the at least two retaining apertures, wherein each aperture cover further comprises a rotatable lining bag retaining tab secured to a bottom surface of the aperture cover; and, a hinge securing the lining bag retaining tab to the aperture cover and a torsion spring, wherein a first end of the torsion spring is secured to the aperture cover and a second end is secured proximal to a base of the lining bag retaining tab.

5. The apparatus of claim 4 wherein each lining bag retaining tab comprises a hook formed proximal to an end of the lining bag retaining tab distal from the hinge and facing inwardly and downwardly relative to the orientation of the waste basket container.

6. The apparatus of claim 4 wherein the lining bag retaining tab has a stepped outer edge.

7. The apparatus of claim 4 wherein the lining bag retaining tab tab has a rounded apex end distal from the end connected to the aperture cover.

* * * * *